US011779087B2

(12) United States Patent
Yamashita et al.

(10) Patent No.: US 11,779,087 B2
(45) Date of Patent: Oct. 10, 2023

(54) BAND AND TIMEPIECE

(71) Applicant: Seiko Epson Corporation, Tokyo (JP)

(72) Inventors: Yuki Yamashita, Shiojiri (JP); Takumi Oshio, Shiojiri (JP); Toru Takiuchi, Matsumoto (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/727,903

(22) Filed: Apr. 25, 2022

(65) Prior Publication Data

US 2022/0338600 A1 Oct. 27, 2022

(30) Foreign Application Priority Data

Apr. 26, 2021 (JP) ..... 2021-073867

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/145; Y10T 24/4718; G04B 37/1493; G04B 37/16
See application file for complete search history.

(56) References Cited

U.S. PATENT DOCUMENTS

| | | | | |
|---|---|---|---|---|
| 2,007,538 | A * | 7/1935 | Kraemer | G04B 37/1493 24/265 B |
| 8,240,011 | B2 * | 8/2012 | Chevrolet | G04B 37/1493 24/265 B |
| 9,314,071 | B2 * | 4/2016 | Rivera | A44C 5/2071 |
| 9,743,724 | B2 * | 8/2017 | Dornhege | A44C 5/14 |
| 9,962,121 | B2 * | 5/2018 | Yoo | A41D 20/00 |
| 10,168,736 | B2 * | 1/2019 | Lee | G04B 37/1493 |
| 10,935,934 | B2 * | 3/2021 | Maire | G04B 37/1493 |
| 11,419,395 | B2 * | 8/2022 | Yamashita | A44C 5/2061 |
| 11,464,301 | B2 * | 10/2022 | Pesenti | A44C 5/147 |
| 2014/0250637 | A1 * | 9/2014 | Stotz | G04B 37/1493 24/265 B |
| 2022/0061475 | A1 * | 3/2022 | Nakatsuka | A44C 5/147 |
| 2022/0095750 | A1 * | 3/2022 | Maruyama | A44C 5/142 |
| 2022/0163928 | A1 * | 5/2022 | Hata | G04G 17/06 |

FOREIGN PATENT DOCUMENTS

JP 2020-168218 A 10/2020

* cited by examiner

*Primary Examiner* — Robert Sandy
*Assistant Examiner* — Louis A Mercado
(74) *Attorney, Agent, or Firm* — Harness, Dickey & Pierce, P.L.C.

(57) ABSTRACT

A band includes a spring rod including a first operation lever linked to a first slider and a second operation lever linked to a second slider, a first piece including a first portion, a second portion, and a linkage section that links the first portion and the second portion to each other, the first piece having a first recess in each of the first portion and the second portion, and a second piece disposed between the first portion and the second portion, the second piece having a second recess. The spring rod is disposed in a closed curve that is the combination of a left first recess, a right first recess, and the second recess in the side view viewed in an axial direction of the spring rod. The second piece is disposed between the first operation lever and the second operation lever.

7 Claims, 26 Drawing Sheets

BAND AND TIMEPIECE

The present application is based on, and claims priority from JP Application Serial Number 2021-073867, filed Apr. 26, 2021, the disclosure of which is hereby incorporated by reference herein in its entirety.

BACKGROUND

1. Technical Field

The present disclosure relates to a band and a timepiece.

2. Related Art

JP-A-2020-168218 discloses a band linked with a spring rod, and a wristwatch. According to JP-A-2020-168218, the spring rod includes sliders at opposite ends thereof. The spring urges the sliders at opposite ends outward. The sliders are provided with lever sections as operation levers. An operator can pinch the lever sections to shorten the spring. A through hole is formed in each piece of the band. The spring rod is inserted into the through hole.

A pair of holes into which the sliders are inserted are formed in a case of the timepiece. The pair of holes are disposed as to face each other. The operator pinches the lever sections to shorten the spring so as to shorten the overall length of the spring rod. The operator then insert the pair of sliders into the pair of holes in the case and releases the lever sections. The spring rod causes the piece of the band to be linked to the case.

One of the lever sections of the spring rod described in JP-A-2020-168218 has a male thread formed therearound. A female thread is formed in one of the sliders. The one lever section is attachable and detachable to and from the slider. To incorporate the spring rod into the band, the operator removes the lever section from the one slider and inserts the spring rod into the through hole in the piece of the band. The operator then needs to fix the lever section to the slider by using the threads. That is, to assemble the spring rod, one of the two operation levers is configured to be fixed by using the threads. The configuration described above makes it difficult to attach the one lever section to the spring rod because the lever sections are small parts, resulting in an increase in the number of manufacturing steps, a decrease in the yield of the band, and other problems.

SUMMARY

A band includes a spring rod including a first operation lever linked to a first slider and a second operation lever linked to a second slider, a first piece including a first portion, a second portion, and a linkage section that links the first portion and the second portion to each other, and a second piece disposed between the first portion and the second portion. The first piece has a first recess in each of the first portion and the second portion. The second piece has a second recess. In a side view viewed in an axial direction of the spring rod, the spring rod is disposed in a closed curve that is a combination of the first recess and the second recess or a combination of the second recess and the linkage section. The second piece is disposed between the first operation lever and the second operation lever.

A timepiece includes the band described above.

DESCRIPTION OF EXEMPLARY EMBODIMENTS

First Embodiment

Figure 1:
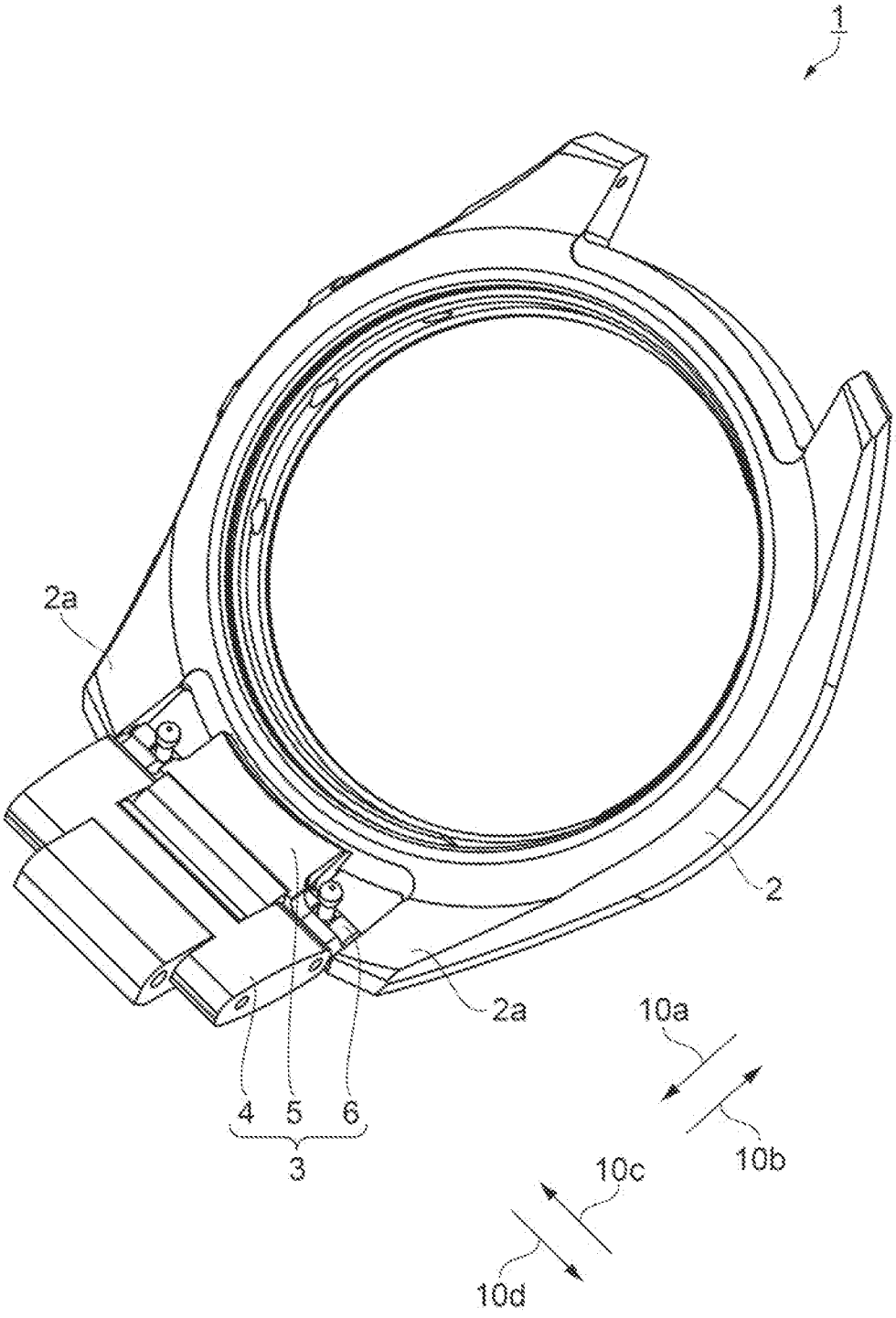
FIG. 1 is a schematic perspective view showing the configurations of a band and a timepiece according to a first embodiment.

In the present embodiment, a characteristic example of a band and a wristwatch coupled to the band will be described with reference to the drawings. The band and the timepiece according to the first embodiment will be described with reference to the drawings. In a timepiece 1, a band 3 is coupled to a case 2, as shown in FIG. 1. The timepiece 1 is a wristwatch. FIG. 1 does not show a movement, a dial, a windshield, a case back, or other components incorporated in the case 2 of the timepiece 1. The direction from the windshield toward the case back is called a rearward direction 10*c*. The direction from the case back toward the windshield is called a frontward direction 10*d*. FIG. 1 shows the timepiece 1 viewed from side facing against the rearward direction 10*c*.

The band 3 includes a band piece 4, a linkage piece 5, and a spring rod 6. Out of the opposite directions from the case 2 toward the band 3 and vice versa, the direction facing 6 o'clock on the dial is called a 6-o'clock direction 10*a*. The direction opposite the 6-o'clock direction 10*a* is called a 12-o'clock direction 10*b*. A plurality of band pieces 4 are linked to each other in accordance with the circumferential length of the arm around which the band 3 is wound. FIG. 1 shows only one of the band pieces 4. The linkage piece 5 is disposed at each end of the plurality of band pieces 4 linked to each other. The linkage piece 5 is disposed between the end-side band piece 4 and the case 2. The spring rod 6 is a part that couples the linkage piece 5 to the case 2.

The case 2 includes a pair of band attaching sections 2*a*. The linkage piece 5 is disposed between the pair of band attaching sections 2*a*. The spring rod 6 couples the pair of band attaching sections 2*a* to the linkage piece 5.

Figure 2:
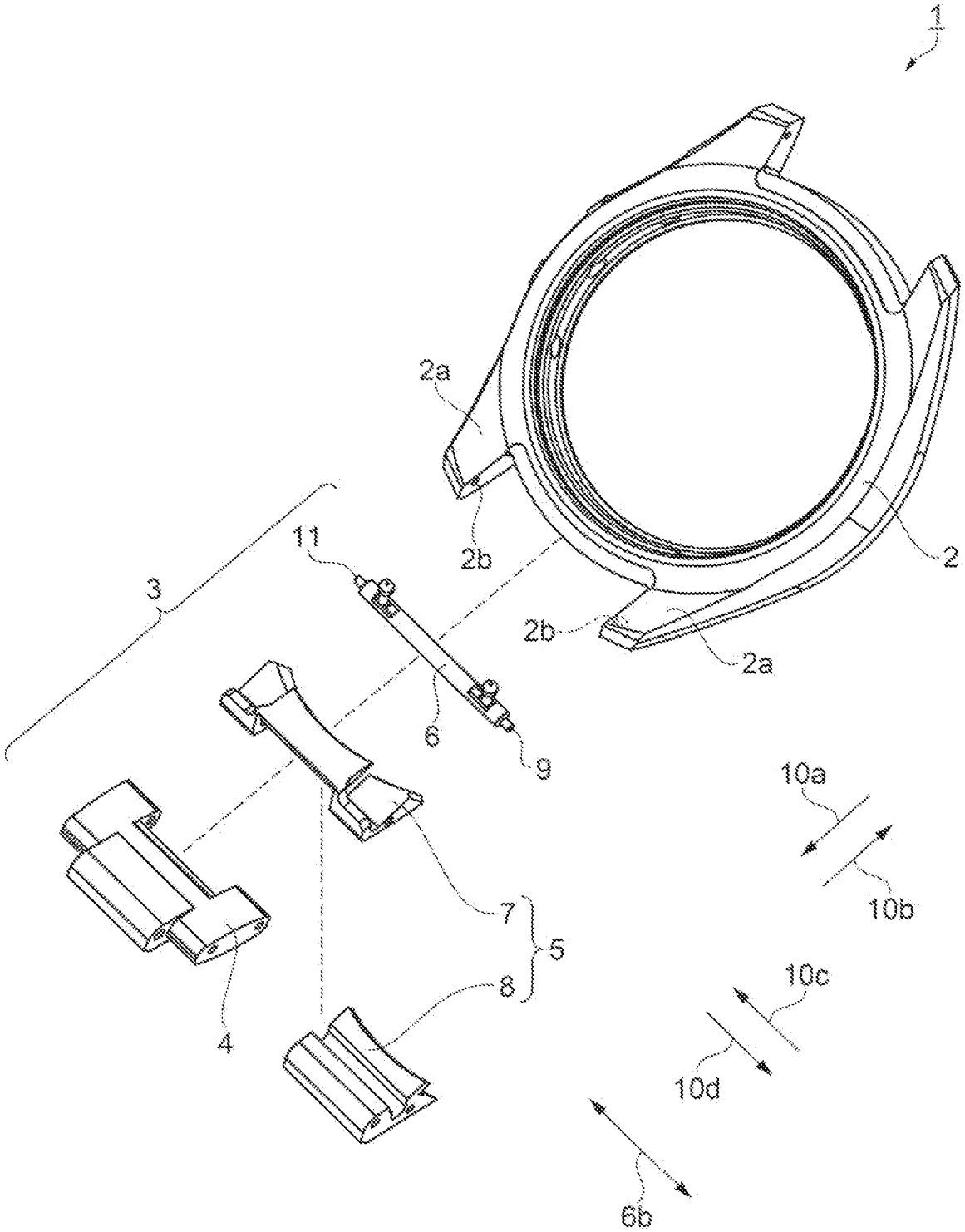
FIG. 2 is a schematic exploded view perspective showing the configurations of the band and the timepiece.

FIG. 2 is a perspective view of the timepiece 1 viewed from the side facing against the rearward direction 10*c*. The linkage piece 5 includes a first piece 7 and a second piece 8, as shown in FIG. 2. The spring rod 6 is sandwiched between the first piece 7 and the second piece 8. A first slider 9 is disposed at one end of the spring rod 6, and a second slider 11 is disposed at the other end of the spring rod 6. An attachment hole 2*b* is provided in each of the pair of band attaching sections 2*a*.

The first slider 9 and the second slider 11 are inserted into the attachment holes 2*b*. The spring rod 6 is disposed so as to be attachable and detachable to and from the band attaching sections 2*a*. The linkage piece 5 is therefore attachable and detachable to and from the case 2.

Figure 3:
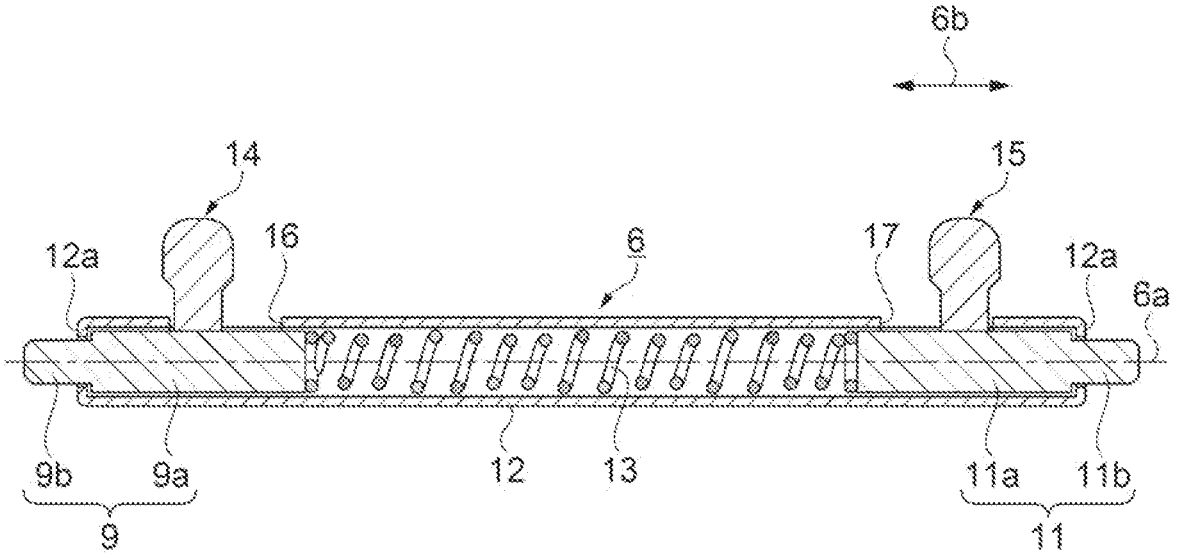
FIG. 3 is a diagrammatic side cross-sectional view showing the structure of a spring rod.

The spring rod 6 includes a tubular pipe section 12, as shown in FIG. 3. A spring 13 is disposed in the pipe section 12. The spring 13 is a coil spring. The first slider 9 and the second slider 11 are disposed in the pipe section 12 so as to be slidable along an axis 6*a* of the spring rod 6. The opposite directions along the axis 6*a* of the spring rod 6 are called an axial direction 6*b* of the spring rod 6. The spring 13 is disposed between the first slider 9 and the second slider 11. The spring 13 urges the first slider 9 and the second slider 11. The spring 13 presses the first slider 9 and the second slider 11 outward via the opposite sides of the pipe section 12.

The first slider 9 includes a large-diameter first slide body 9*a* and a small-diameter first protrusion 9*b*. The outer shape of the first slide body 9*a* is slightly smaller than the inner diameter of the pipe section 12, so that the first slide body 9*a* slides in the pipe section 12. The second slider 11 includes a large-diameter second slide body 11*a* and a small-diameter second protrusion 11*b*. The outer shape of the second slide body 11*a* is slightly smaller than the inner diameter of the pipe section 12, so that the second slide body 11*a* slides in the pipe section 12.

A first operation lever 14 is disposed at the first slide body 9*a*. A second operation lever 15 is disposed at the second slide body 11*a*. An operator operates the first operation lever 14 to cause the first slider 9 to slide. The operator operates the second operation lever 15 to cause the second slider 11 to slide. The operator operates the first operation lever 14 and the second operation lever 15 to insert and take the first protrusion 9*b* and the second protrusion 11*b* into and out of the pipe section 12.

Retainers 12*a* are disposed at opposite ends of the pipe portion 12. The retainers 12*a* prevent the first slider 9 and the second slider 11 from coming off the pipe section 12. The first protrusion 9*b* and the second protrusion 11*b* protrude out of the retainers 12*a*.

The pipe section 12 has a first slide hole 16 on the side facing the first slider 9. The first slide hole 16 is elongated in the axial direction of the spring rod 6. The first operation lever 14 protrudes out of the first slide hole 16. The pipe section 12 has a second slide hole 17 on the side facing the second slider 11. The second slide hole 17 is elongated in the axial direction of the spring rod 6. The second operation lever 15 protrudes out of the second slide hole 17. The first operation lever 14 and the second operation lever 15 are movable in the axial direction of the spring rod 6. The spring rod 6 includes the first operation lever 14 linked to the first slider 9 and the second operation lever 15 linked to the second slider 11, as described above.

Figure 4:
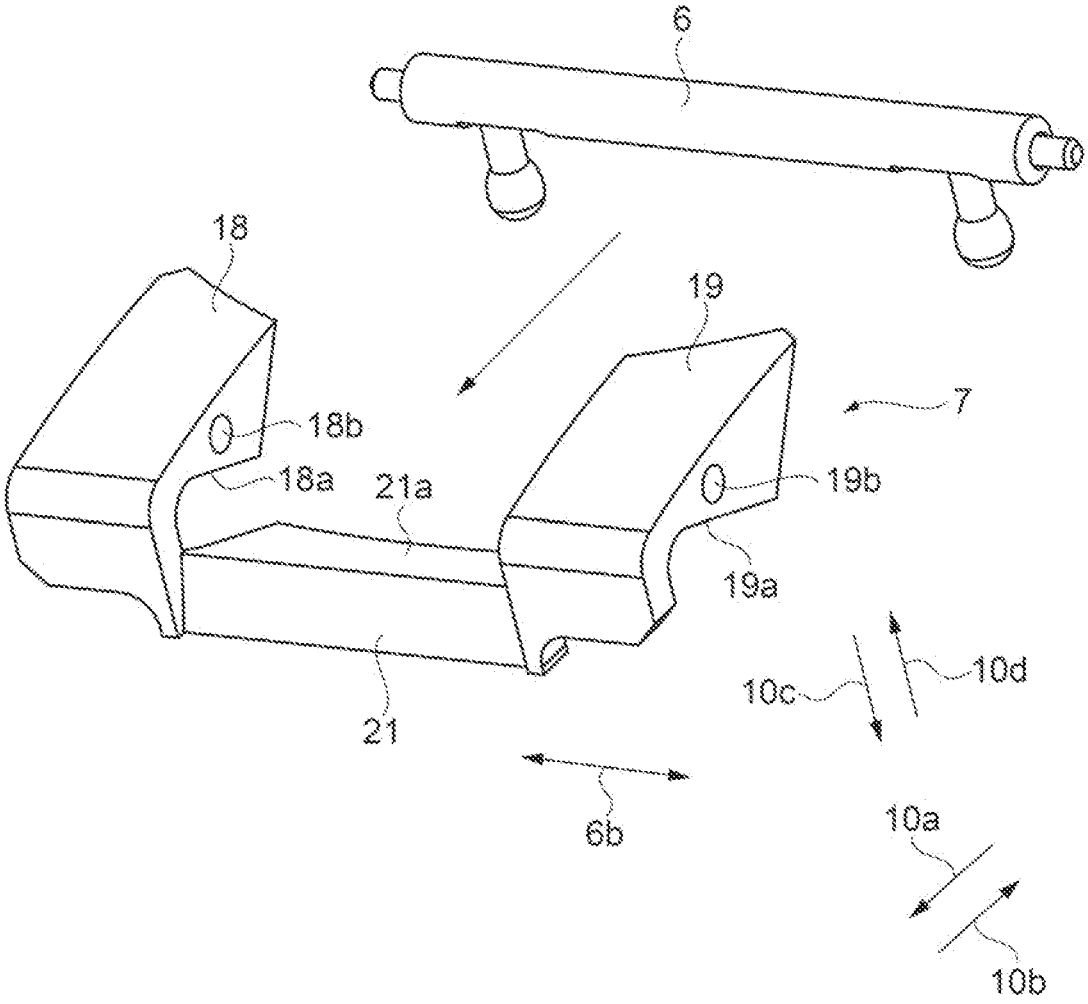
FIG. 4 is a diagrammatic view for describing a method for assembling the band.

The procedure of assembling the linkage piece 5 and the spring rod 6 will next be described. The first piece 7 includes a first portion 18, a second portion 19, and a linkage section 21, which links the first portion 18 and the second portion 19 to each other, as shown in FIG. 4. The first portion 18 of the first piece 7 has a left first recess 18*a* as a first recess and a third recess. The second portion 19 of the first piece 7 has a right first recess 19*a* as the first recess and a fourth recess. The first portion 18 of the first piece 7 has a left first fixing hole 18*b* as a first hole. The second portion 19 of the first piece 7 has a right first fixing hole 19*b* as the first hole. The left first fixing hole 18*b* and the right first fixing hole 19*b* are coaxially disposed and extend in the axial direction 6*b*.

The spring rod 6 is disposed on a first surface 21*a* of the linkage section 21, the surface facing in the frontward direction 10*d*. Furthermore, the spring rod 6 is disposed in the left first recess 18*a* and the right first recess 19*a*. As a result, the first piece 7 and the spring rod 6 are assembled, as shown in FIG. 5.

Figure 5:
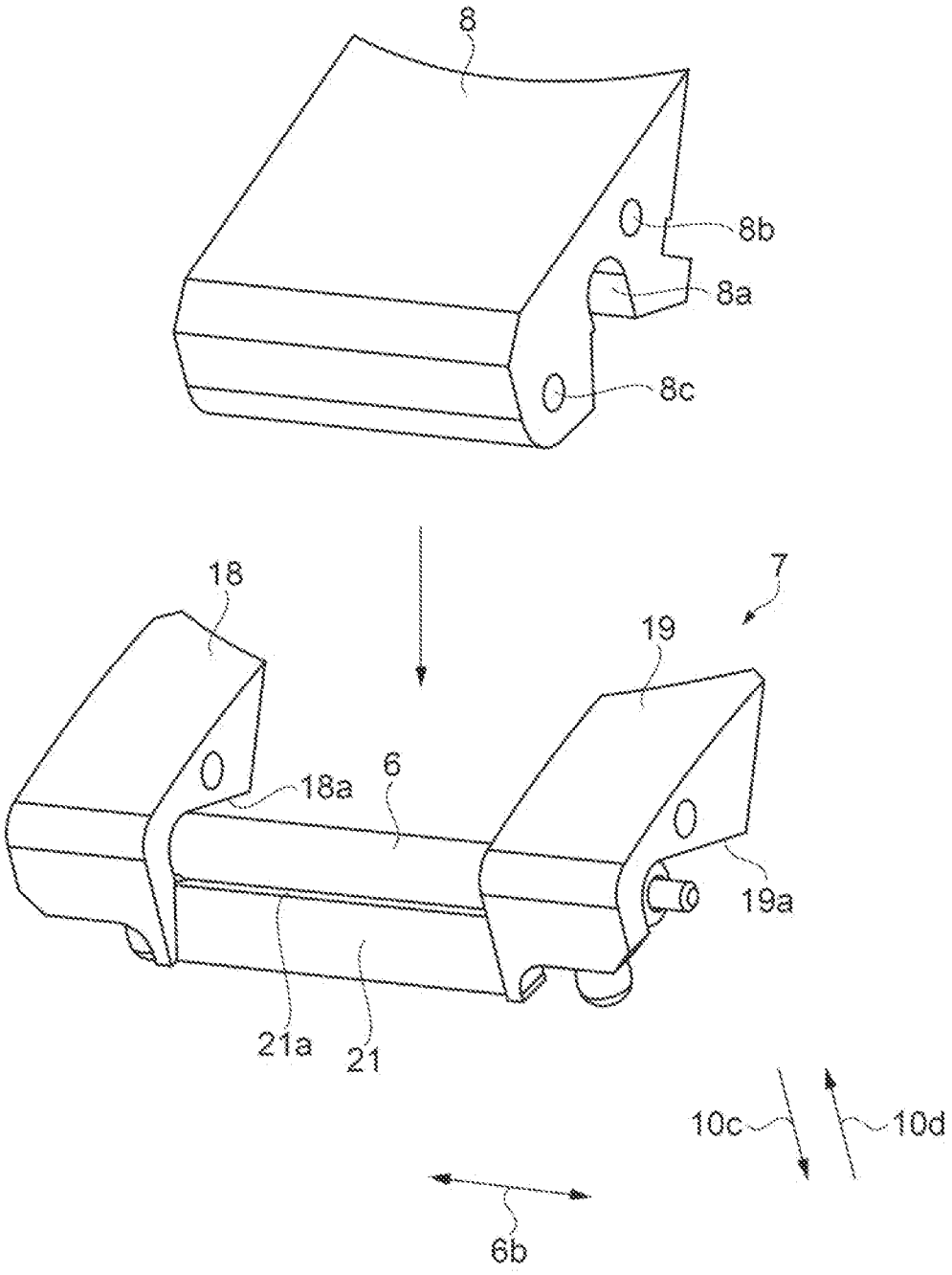
FIG. 5 is a diagrammatic view for describing the method for assembling the band.

The second piece 8 has a second recess 8*a* on the side facing in the rearward direction 10*c*, as shown in FIG. 5. The second piece 8 has a second fixing hole 8*b* and a second linkage hole 8*c* as a second hole. The second fixing hole 8*b* and the second linkage hole 8*c* extend in the axial direction 6*b*. The second linkage hole 8*c* is used to link the band piece 4 and the linkage piece 5 to each other.

Figure 6:
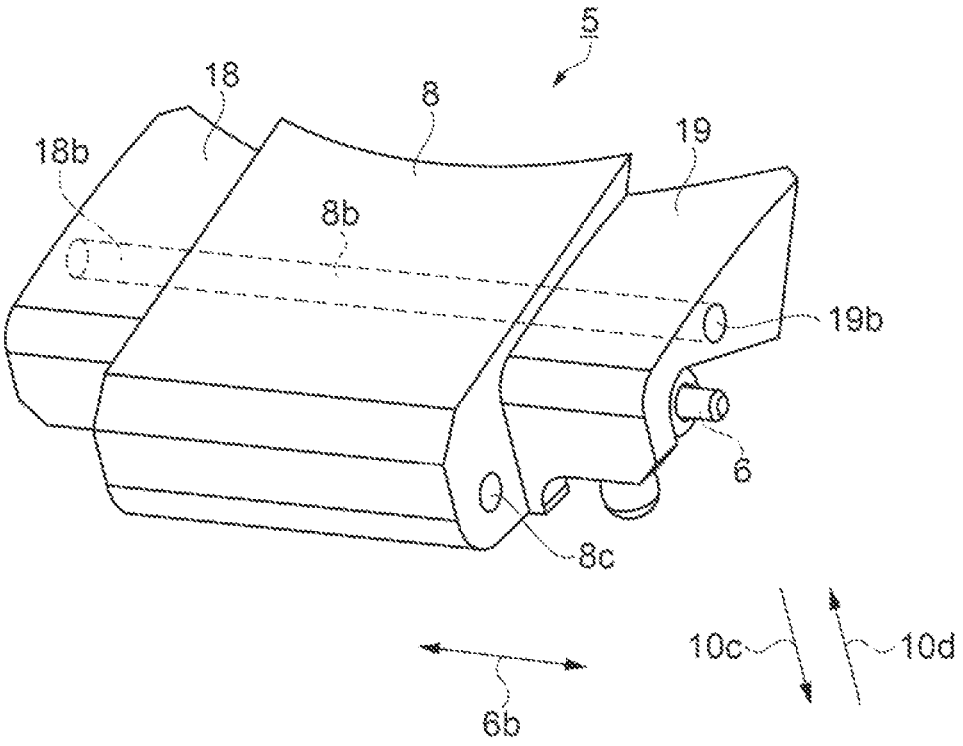
FIG. 6 is a diagrammatic view for describing the method for assembling the band.
Figure 7:
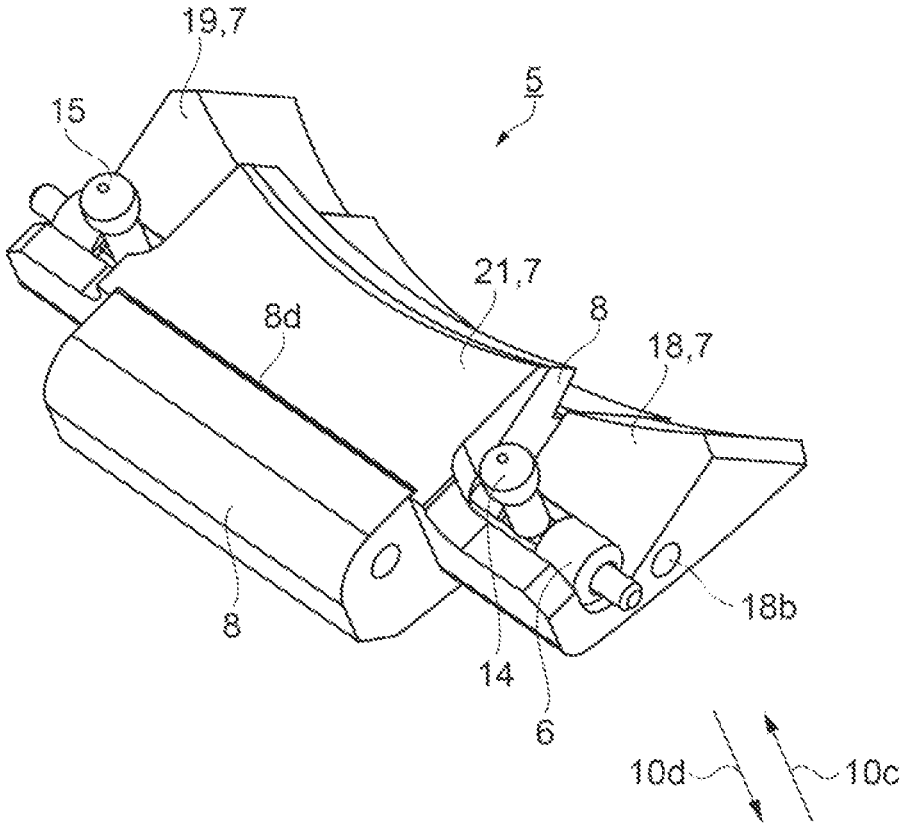
FIG. 7 is a diagrammatic view for describing the method for assembling the band.

The second piece 8 is disposed between the first portion 18 and the second portion 19. The spring rod 6 is disposed in the second recess 8*a*. The linkage section 21 closes the second recess 8*a*. As a result, the linkage piece 5 is assembled as shown in FIGS. 6 and 7. FIG. 6 shows the linkage piece 5 viewed from the side facing against the frontward direction 10*d*. FIG. 7 shows the linkage piece 5 viewed from the side facing against the rearward direction 10*c*. The second piece 8 is disposed between the first operation lever 14 and the second operation lever 15.

The left first fixing hole 18*b* and the right first fixing hole 19*b* formed in the first piece 7 and the second fixing hole 8*b* formed in the second piece 8 are arranged along the same line. A pin that is not shown is inserted into the left first fixing hole 18*b*, the second fixing hole 8*b*, and the right first fixing hole 19*b* to fix the first piece 7 and the second piece 8 to each other. C rings are attached to the pin so as not to allow the pin from coming off the linkage piece 5.

According to the configuration described above, the pin is inserted into the left first fixing hole 18*b*, the second fixing hole 8*b*, and the right first fixing hole 19*b* to fix the first piece 7 and the second piece 8 to each other, whereby the first piece 7 and the second piece 8 can be readily fixed to each other. Instead, laser light may be radiated to a coupling section 8*d*, where the second piece 8 is coupled to the linkage section 21, to weld the second piece 8 to the linkage section 21.

Figure 8:
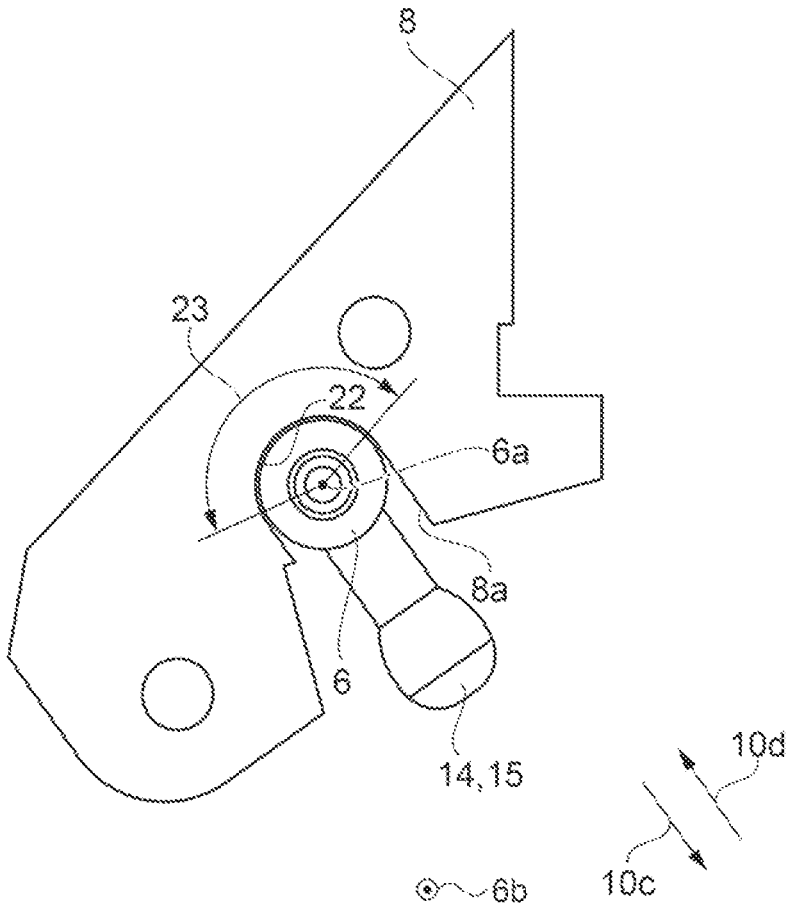
FIG. 8 is a diagrammatic view for describing the shape of recesses.

The shape of the left first recess 18*a*, the right first recess 19*a*, and the second recess 8*a* will next be described. FIG. 8 shows the second piece 8 viewed in the axial direction 6*b*. A second angular range 23, which is formed of angles around the axis 6*a* of the spring rod 6 and corresponds to the range of a second contact section 22, where the second recess 8*a* is in contact with the spring rod 6, is greater than or equal to 20 degrees but smaller than or equal to 180 degrees. When the second angular range 23 is smaller than 20 degrees, the positional shift of the spring rod 6 from the second recess 8*a* in a direction that intersects with the axis of the spring rod 6 can undesirably increase. The positional shift causes the outer circumferential surface of the spring rod 6 to rub against the second recess 8*a* and wear down, undesirably causing the spring rod 6 to rattle relative to the linkage piece. When the second angular range 23 is greater than 180 degrees, the spring rod 6 cannot be inserted into the second recess 8*a* in the direction that intersects with the axis of the spring rod 6.

Figure 9:
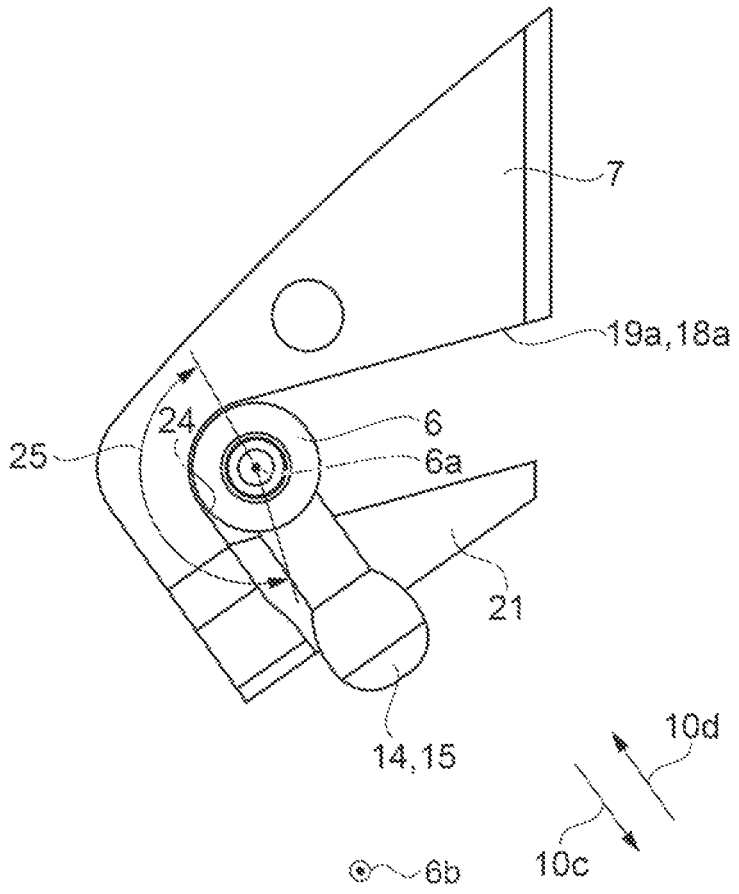
FIG. 9 is a diagrammatic view for describing the shape of the recesses.

FIG. 9 shows the first piece 7 viewed in the axial direction 6*b*. A first angular range 25, which is formed of angles around the axis 6*a* of the spring rod 6 and corresponds to the range of a first contact section 24, where the left first recess 18*a*, the right first recess 19*a*, and the linkage section 21 are in contact with the spring rod 6, is greater than or equal to 20 degrees but smaller than or equal to 180 degrees. When the first angular range 25 is smaller than 20 degrees, the positional shift of the spring rod 6 from the left first recess 18*a* and the right first recess 19*a* in the direction that intersects with the axis of the spring rod 6 can undesirably increase. The positional shift causes the outer circumferential surface of the spring rod 6 to rub against the left first recess 18*a* and the right first recess 19*a* and wear down, undesirably causing the spring rod 6 to rattle relative to the linkage piece. When the first angular range 25 is greater than 180 degrees, the spring rod 6 cannot be inserted into the left first recess 18*a* or the right first recess 19*a* in the direction that intersects with the axis of the spring rod 6.

Figure 10:
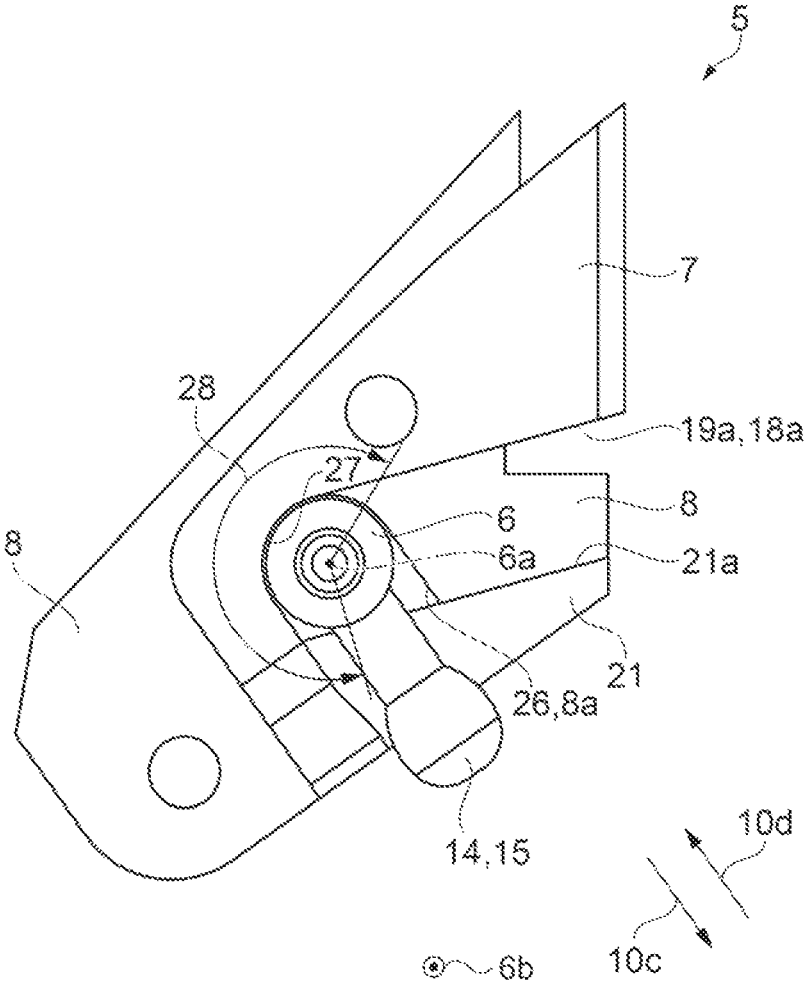
FIG. 10 is a diagrammatic view for describing the shape of a closed curve.

FIG. 10 shows the linkage piece 5 viewed in the axial direction 6*b*. In the side view viewed in the axial direction 6*b* of the spring rod 6, the spring rod 6 is disposed in a closed curve 26, which is the combination of the left first recess 18*a*, the right first recess 19*a*, the second recess 8*a*, and the first surface 21*a* of the linkage section 21. In the side view viewed in the axial direction 6*b* of the spring rod 6, the spring rod 6 may instead be disposed in a closed curve formed of the second recess 8*a* and the first surface 21*a* of the linkage section 21.

According to the configuration described above, the spring rod 6 is sandwiched between the first piece 7 and the second piece 8. In this case, the left first recess 18*a*, the right first recess 19*a*, and the second recess 8*a* form the closed curve 26 in the side view viewed in the axial direction 6*b* of the spring rod 6. That is, the left first recess 18*a*, the right first recess 19*a*, and the second recess 8*a* form a hole. The spring rod 6 is disposed in the hole. Therefore, even when the spring rod 6 is provided with the first operation lever 14 and the second operation lever 15, sandwiching the spring rod 6 between the first piece 7 and the second piece 8 readily allows assembly of the band 3 including the spring rod 6 and the linkage piece 5. As a result, the operation of fixing the operation lever to the slider with the threads can be eliminated, unlike in JP-A-2020-168218.

A third angular range 28, which is formed of angles around the axis 6*a* of the spring rod 6 and corresponds to the range of a third contact section 27, where the left first recess 18*a*, the right first recess 19*a*, and the second recess 8*a* are in contact with the spring rod 6, is greater than 180 degrees but smaller than or equal to 360 degrees. When the third angular range 28 is greater than 180 degrees, the positional shift of the spring rod 6 from the closed curve 26 in the direction that intersects with the axis of the spring rod 6 can be reduced.

According to the configuration described above, since the first angular range 25 is smaller than or equal to 180 degrees, the spring rod 6 can be inserted into the left first recess 18*a* and the right first recess 19*a* from the side facing the opening of the recesses. Since the second angular range 23 is smaller than or equal to 180 degrees, the spring rod 6 can be inserted into the second recess 8*a* from the side facing the opening thereof. Since the third angular range 28 is greater than 180 degrees, the left first recess 18*a*, the right first recess 19*a*, and the second recess 8*a* can readily form the closed curve 26.

The timepiece 1 includes the band 3 described above. According to the configuration described above, the band 3 is a band into which the spring rod 6 can be readily inserted even when the spring rod 6 is provided with the first operation lever 14 and the second operation lever 15. The timepiece 1 can therefore be a timepiece including the band 3 into which the spring rod 6 provided with the first operation lever 14 and the second operation lever 15 can be readily inserted.

Second Embodiment

The present embodiment differs from the first embodiment in terms of the configuration of the linkage piece 5. The same configurations as those in the first embodiment have the same reference characters, and no redundant description of the same configurations will be made.

Figure 11:
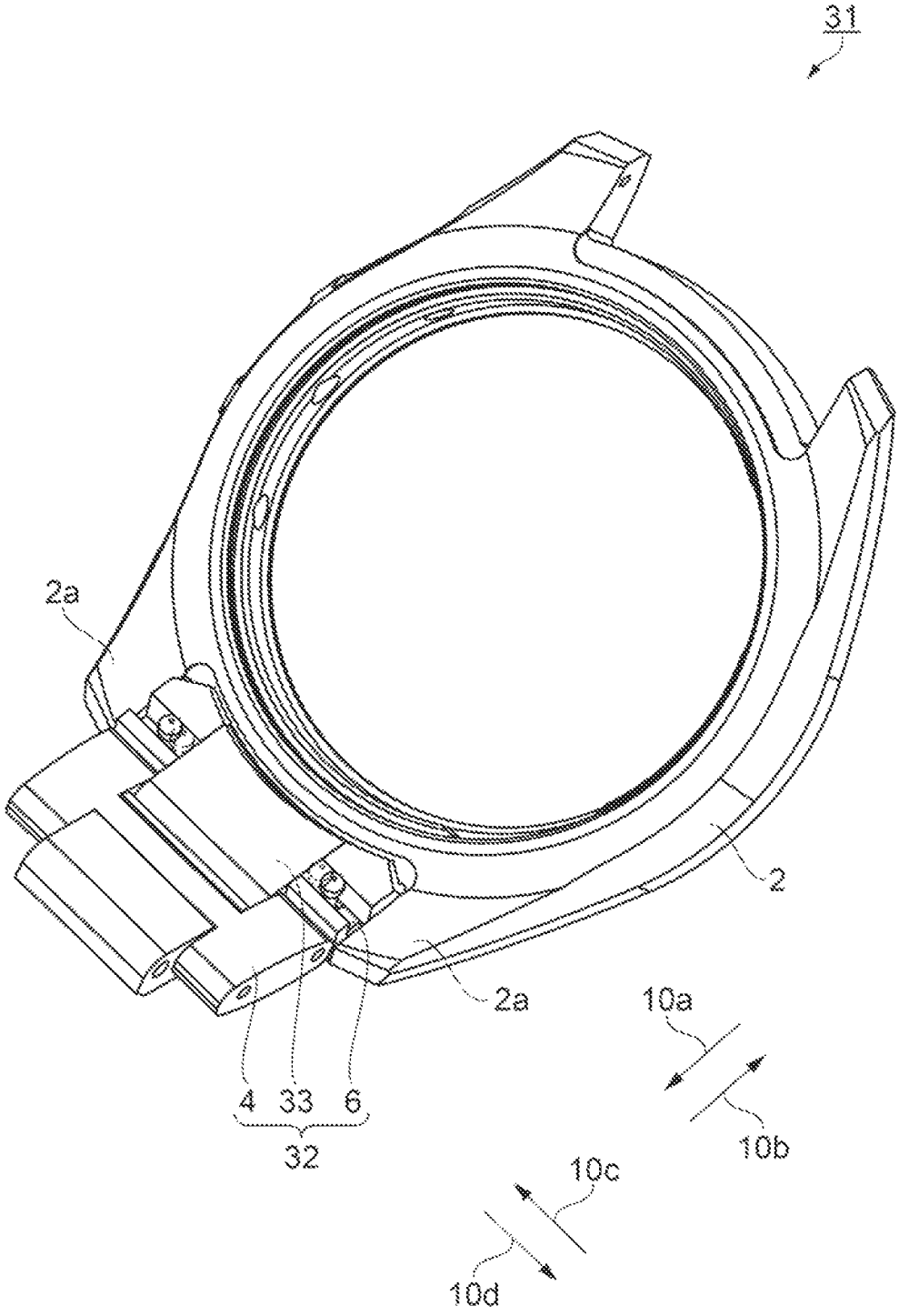
FIG. 11 is a schematic perspective view showing the configurations of a band and a timepiece according to a second embodiment.

In a timepiece 31, a band 32 is coupled to the case 2, as shown in FIG. 11. The timepiece 31 is a wristwatch. FIG. 11 does not show a movement, a dial, a windshield, a case back, or other components incorporated in the case 2 of the timepiece 31. FIG. 11 shows the timepiece 31 viewed from the side facing against the rearward direction 10*c*.

The band 32 includes the band piece 4, a linkage piece 33, and the spring rod 6. FIG. 11 shows only one band piece 4. The linkage piece 33 is disposed at each end of a plurality of band pieces 4 linked to each other. The linkage piece 33 is disposed between the end-side band piece 4 and the case 2. The spring rod 6 couples the pair of band attaching sections 2*a* to the linkage piece 33.

Figure 12:
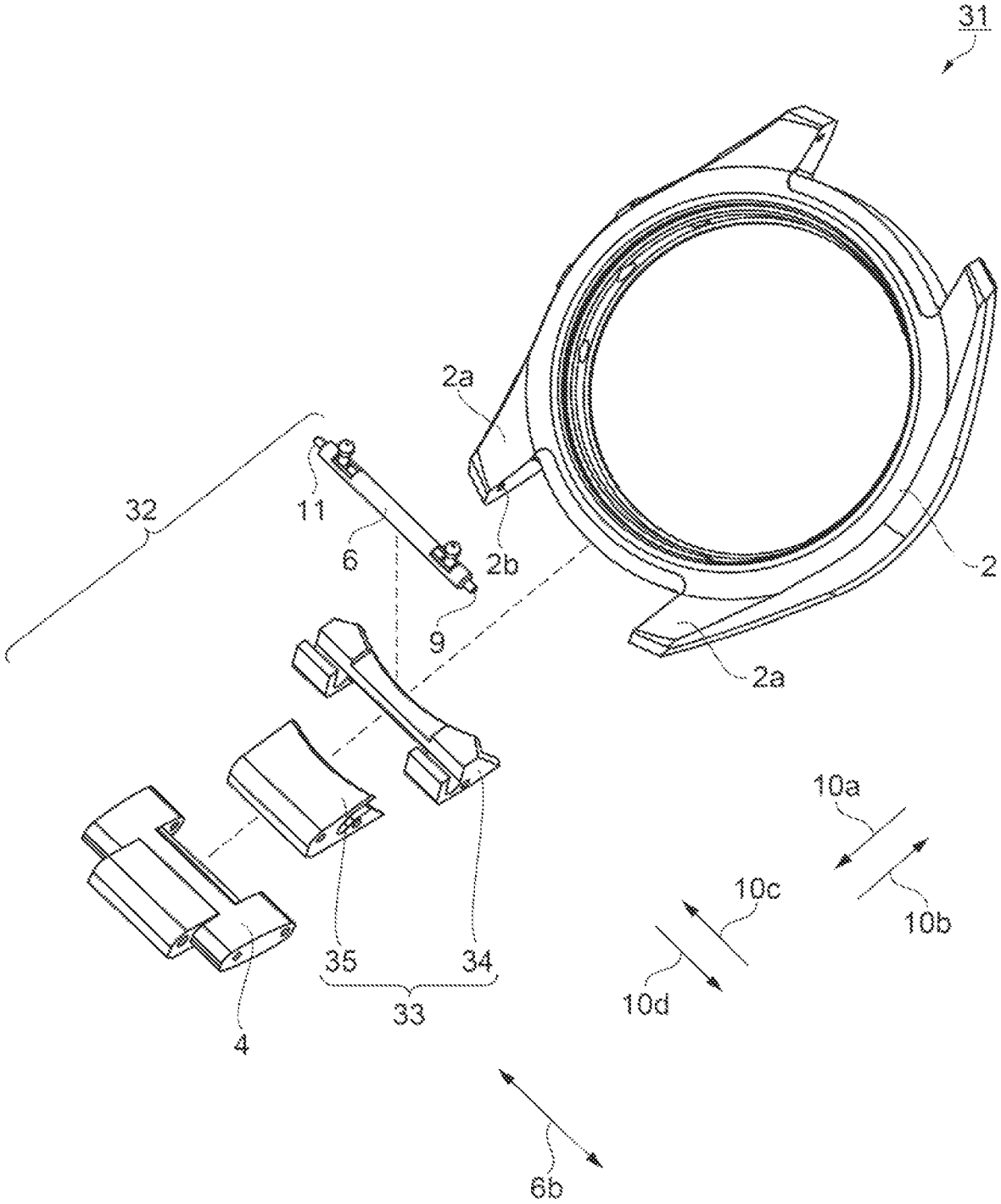
FIG. 12 is a schematic exploded view perspective showing the configurations of the band and the timepiece.

FIG. 12 is a perspective view of the timepiece 31 viewed from the side facing against the rearward direction 10*c*. The linkage piece 33 includes a first piece 34 and a second piece 35, as shown in FIG. 12. The spring rod 6 is sandwiched between the first piece 34 and the second piece 35. The spring rod 6 is disposed so as to be attachable and detachable to and from the band attaching sections 2*a*. The linkage piece 33 is therefore attachable and detachable to and from the case 2.

Figure 13:
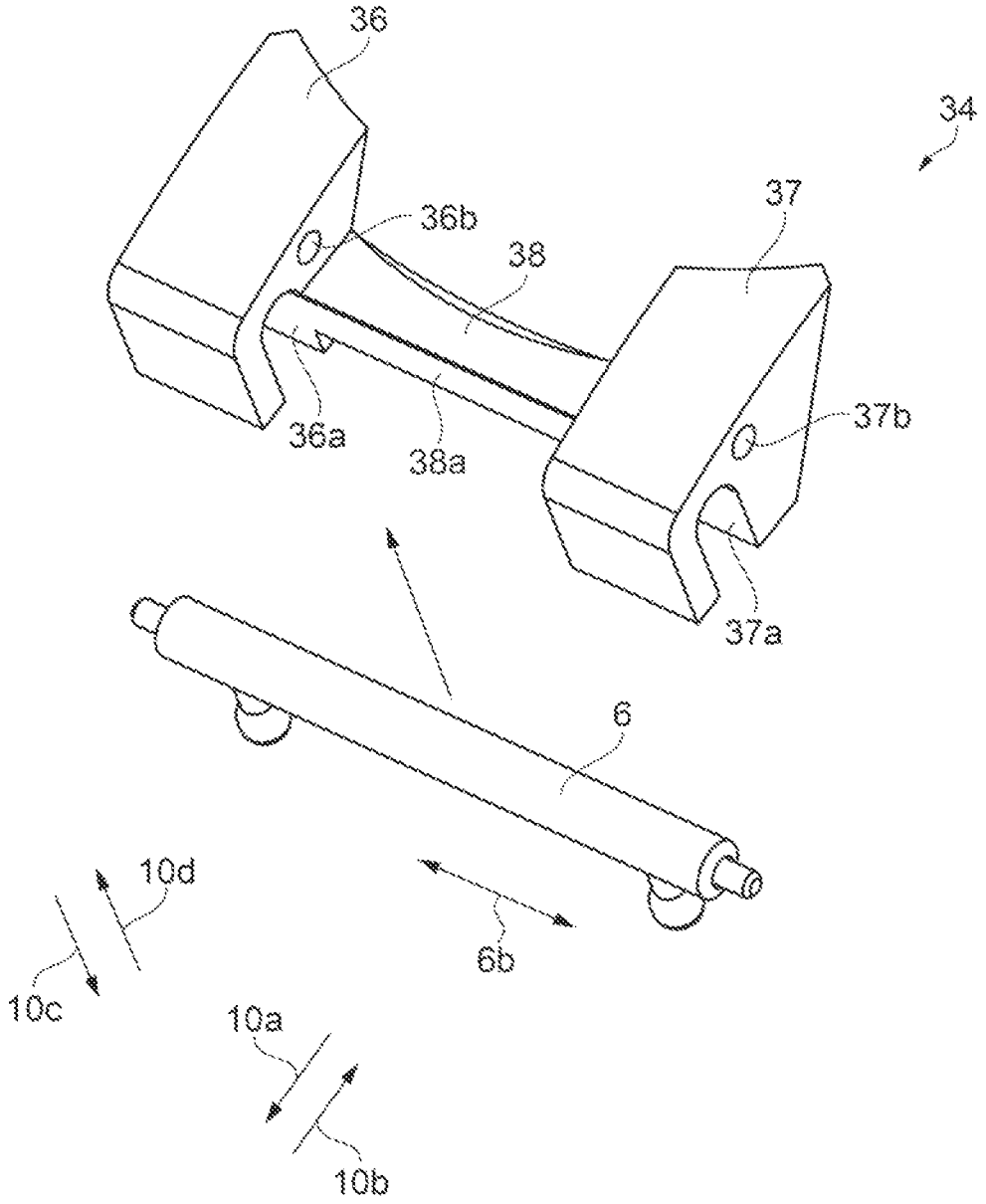
FIG. 13 is a diagrammatic view for describing a method for assembling the band.

The procedure of assembling the linkage piece 33 and the spring rod 6 will next be described. The first piece 34 includes a first portion 36, a second portion 37, and a linkage section 38, which links the first portion 36 and the second portion 37 to each other, as shown in FIG. 13. The first portion 36 of the first piece 34 has a left first recess 36*a* as the first recess and the third recess. The second portion 37 of the first piece 34 has a right first recess 37*a* as the first recess and the fourth recess. The first portion 36 of the first piece 34 has a left first fixing hole 36*b* as the first hole. The second portion 37 of the first piece 34 has a right first fixing hole 37*b* as the first hole. The left first fixing hole 36*b* and the right first fixing hole 37*b* are coaxially disposed and extend in the axial direction 6*b*.

The spring rod 6 is disposed on a second surface 38*a* of the linkage section 38, the surface facing in the 6-o'clock direction 10*a*. Furthermore, the spring rod 6 is disposed in the left first recess 36*a* and the right first recess 37*a*. As a result, the spring rod 6 is incorporated in the first piece 34, as shown in FIG. 14.

Figure 14:
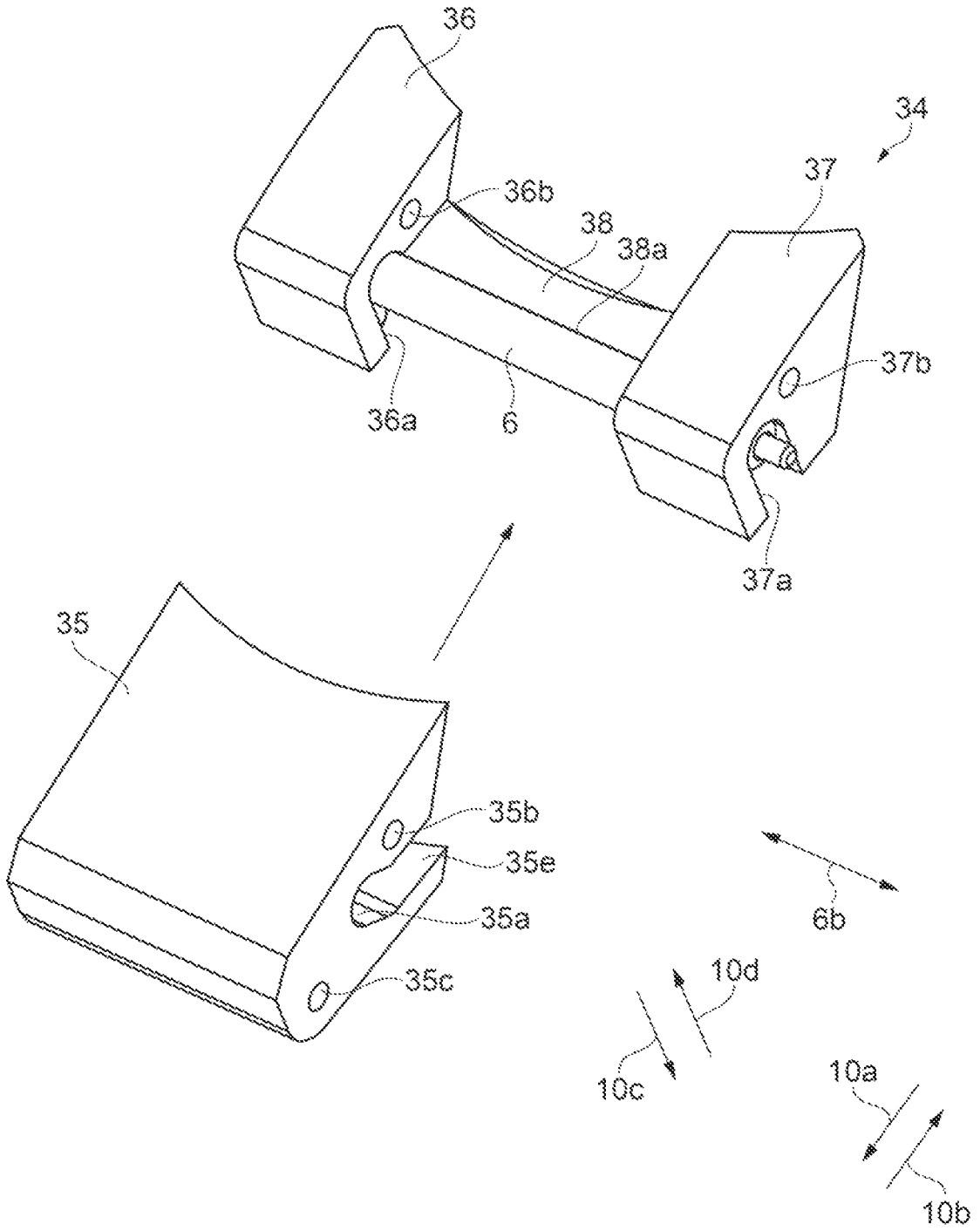
FIG. 14 is a diagrammatic view for describing the method for assembling the band.

The second piece 35 has a second recess 35*a* on the side facing in the 12-o'clock direction 10*b*, as shown in FIG. 14. The second piece 35 has a second fixing hole 35*b* and a second linkage hole 35*c* as the second hole. The second fixing hole 35*b* and the second linkage hole 35*c* extend in the axial direction 6*b*. The second linkage hole 35*c* is used to link the band piece 4 and the linkage piece 33 to each other.

The second piece 35 is disposed between the first portion 36 and the second portion 37. The spring rod 6 is disposed in the second recess 35*a*.

Figure 15:
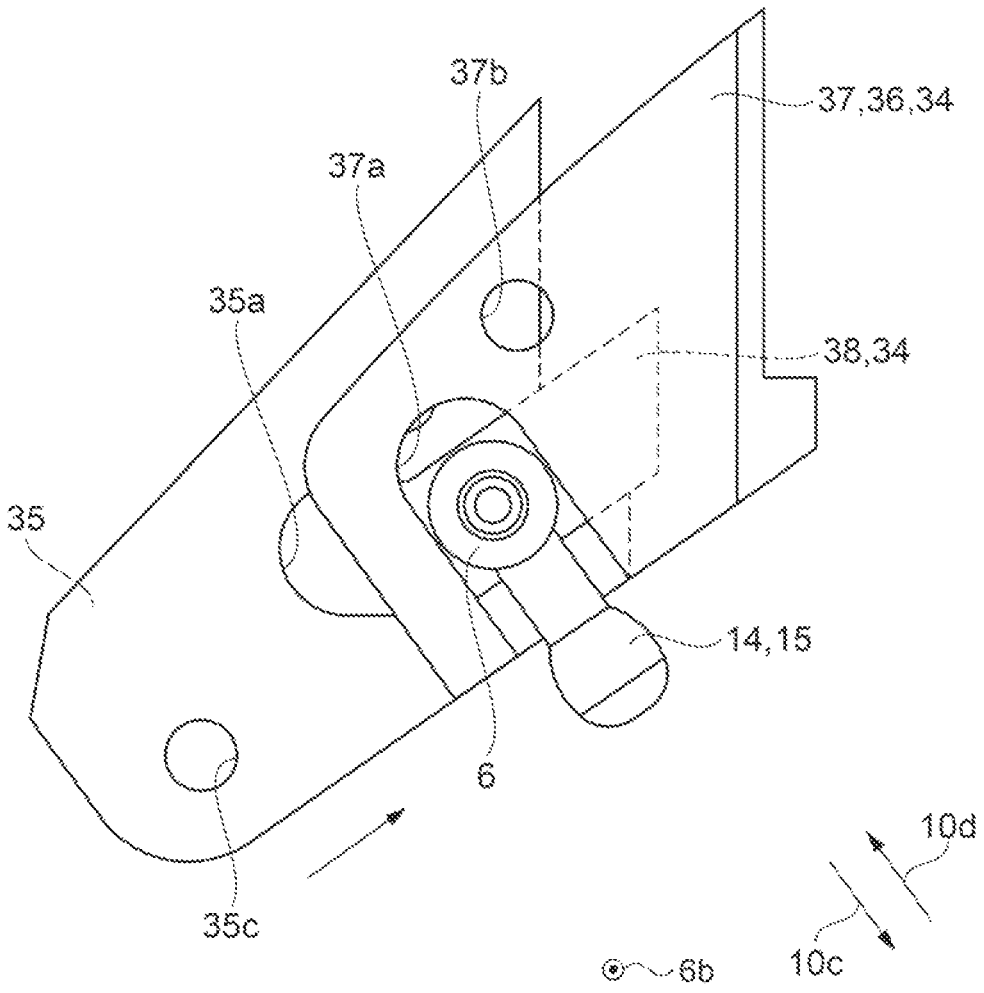
FIG. 15 is a diagrammatic view for describing the method for assembling the band.
Figure 16:
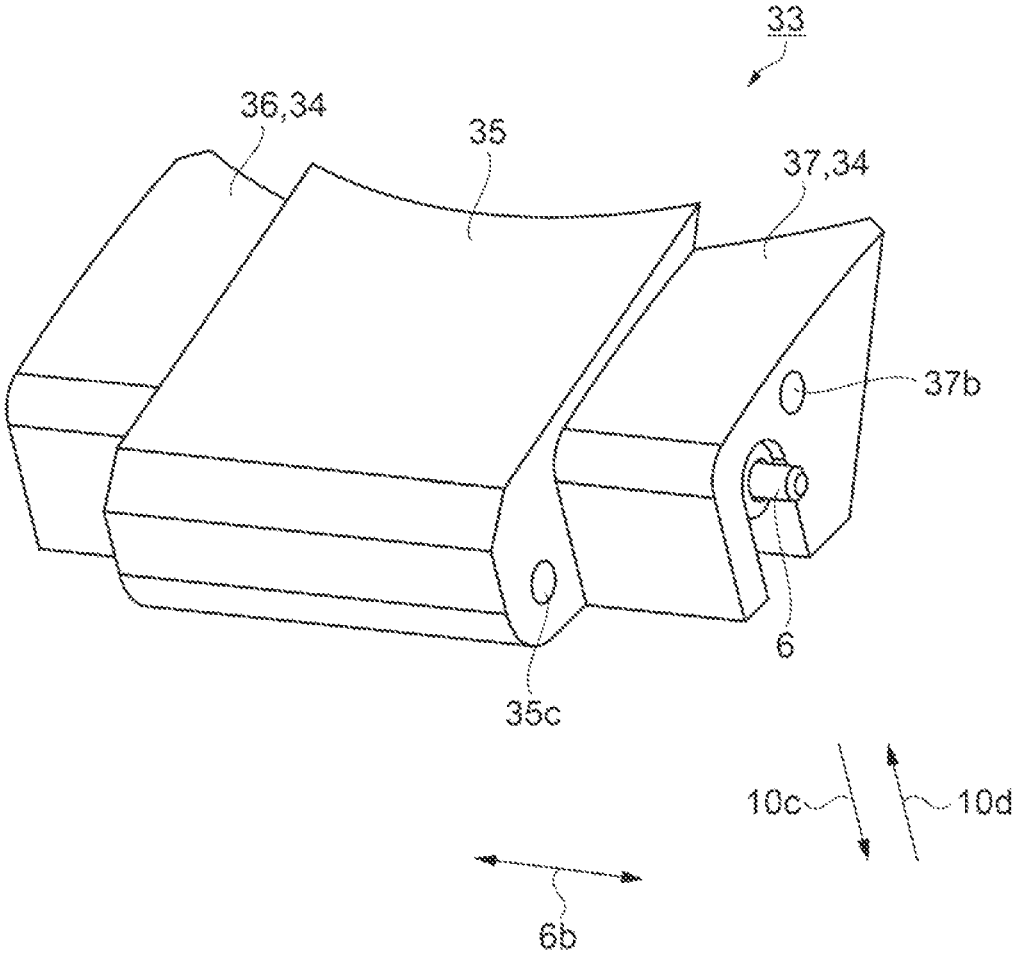
FIG. 16 is a diagrammatic view for describing the method for assembling the band.
Figure 17:
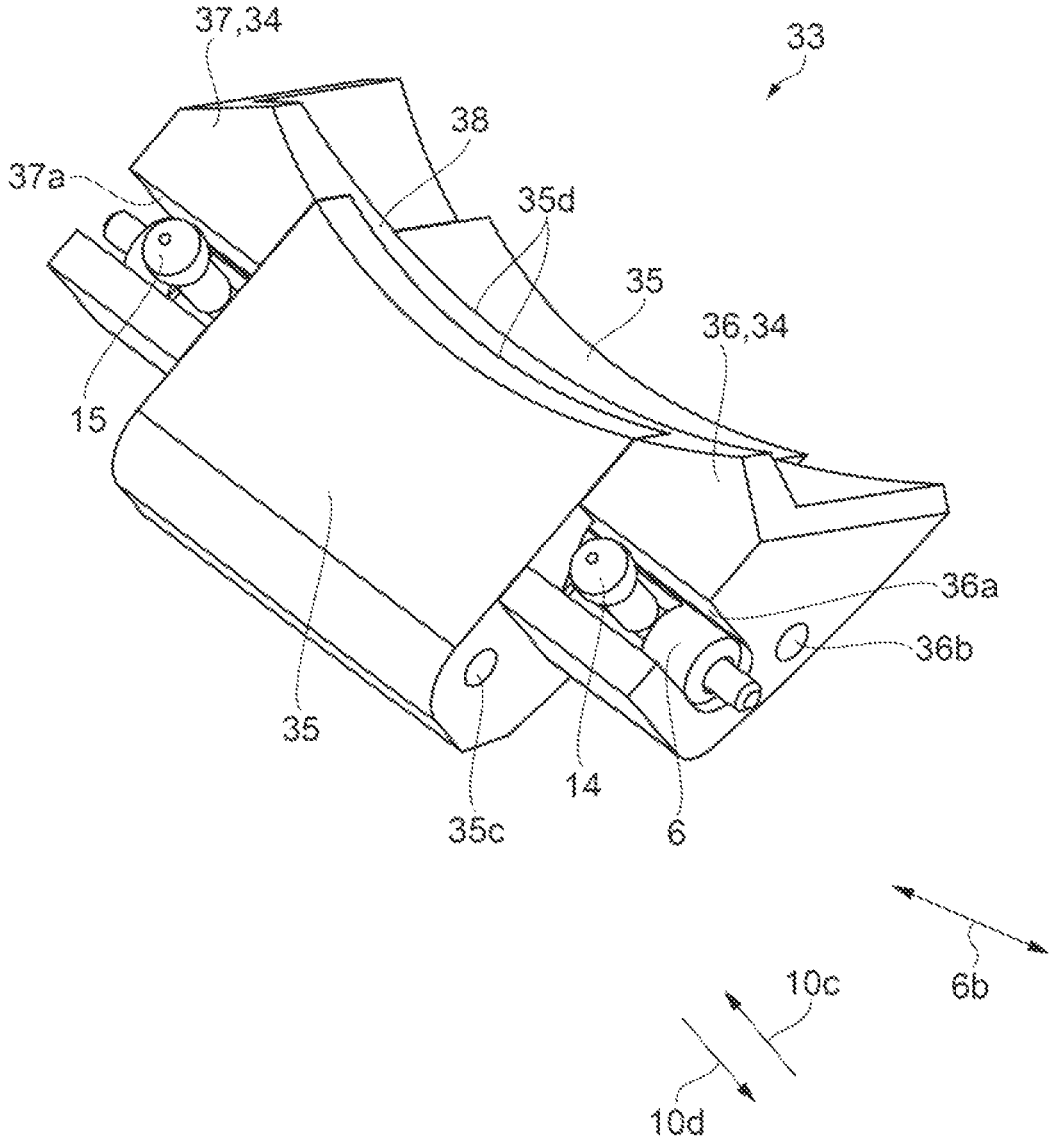
FIG. 17 is a diagrammatic view for describing the method for assembling the band.
Figure 18:
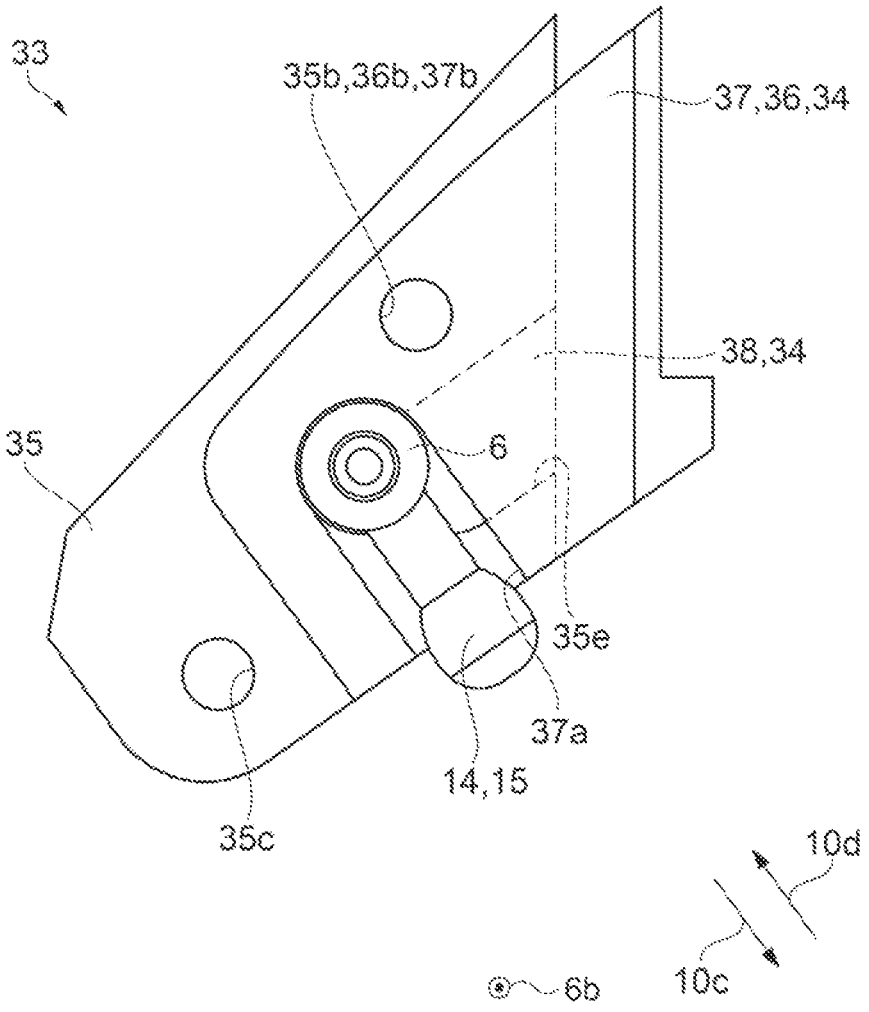
FIG. 18 is a diagrammatic view for describing the method for assembling the band.

The spring rod 6 and the linkage section 38 are inserted into the second recess 35*a*, as shown in FIG. 15. As a result, the linkage piece 33 is assembled as shown in FIGS. 16, 17, and 18. FIG. 16 is a perspective view of the linkage piece 33 viewed from the side facing against the frontward direction 10*d*. FIG. 17 is a perspective view of the linkage piece 33 viewed from the side facing against the rearward direction 10*c*. FIG. 18 shows the linkage piece 33 viewed in the axial direction 6*b*.

The left first fixing hole 36*b* and the right first fixing hole 37*b* formed in the first piece 34 and the second fixing hole 35*b* formed in the second piece 35 are arranged along the same line. A pin that is not shown is inserted into the left first fixing hole 36*b*, the second fixing hole 35*b*, and the right first fixing hole 37*b* to fix the first piece 34 and the second piece 35 to each other. C rings are attached to the pin so as not to allow the pin from coming off the linkage piece 33.

According to the configuration described above, the pin is inserted into the left first fixing hole 36*b*, the second fixing hole 35*b*, and the right first fixing hole 37*b* to fix the first piece 34 and the second piece 35 to each other, whereby the first piece 34 and the second piece 35 can be readily fixed to each other. Instead, laser light may be radiated to a coupling section 35*d*, where the second piece 35 is coupled to the linkage section 38, to weld the second piece 35 to the linkage section 38.

The linkage section 38 is disposed in an opening 35*e* of the second recess 35*a*. The configuration described above determines the positional relationship between the linkage section 38 and the second recess 35*a* and therefore determines the positional relationship between the first piece 34 and the second piece 35. The first piece 34 and the second piece 35 can therefore be readily assembled.

The first operation lever 14 is disposed in the left first recess 36*a* of the first portion 36, as shown in FIGS. 17 and 18. The left first recess 36*a* restricts the rotational movement of the first operation lever 14. The second operation lever 15 is disposed in the right first recess 37*a* of the second portion 37. The right first recess 37*a* restricts the rotational movement of the second operation lever 15.

According to the configuration described above, the spring rod 6 is disposed in the left first recess 36*a* formed in the first portion 36 and the right first recess 37*a* formed in the second portion 37. The left first recess 36*a* restricts the rotational movement of the first operation lever 14. A situation in which the first operation lever 14 rotates and falls down can therefore be avoided. The right first recess 37*a* restricts the rotational movement of the second operation lever 15. A situation in which the second operation lever 15 rotates and falls down can therefore be avoided. In the configuration described above, the first operation lever 14 and the second operation lever 15 are readily movable in the axial direction 6*b* of the spring rod 6 but hardly movable in directions that intersect with the axial direction 6*b*. The left first recess 36*a* and the right first recess 37*a* therefore allow the first operation lever 14 and the second operation lever 15 to be readily operated.

Figure 19:
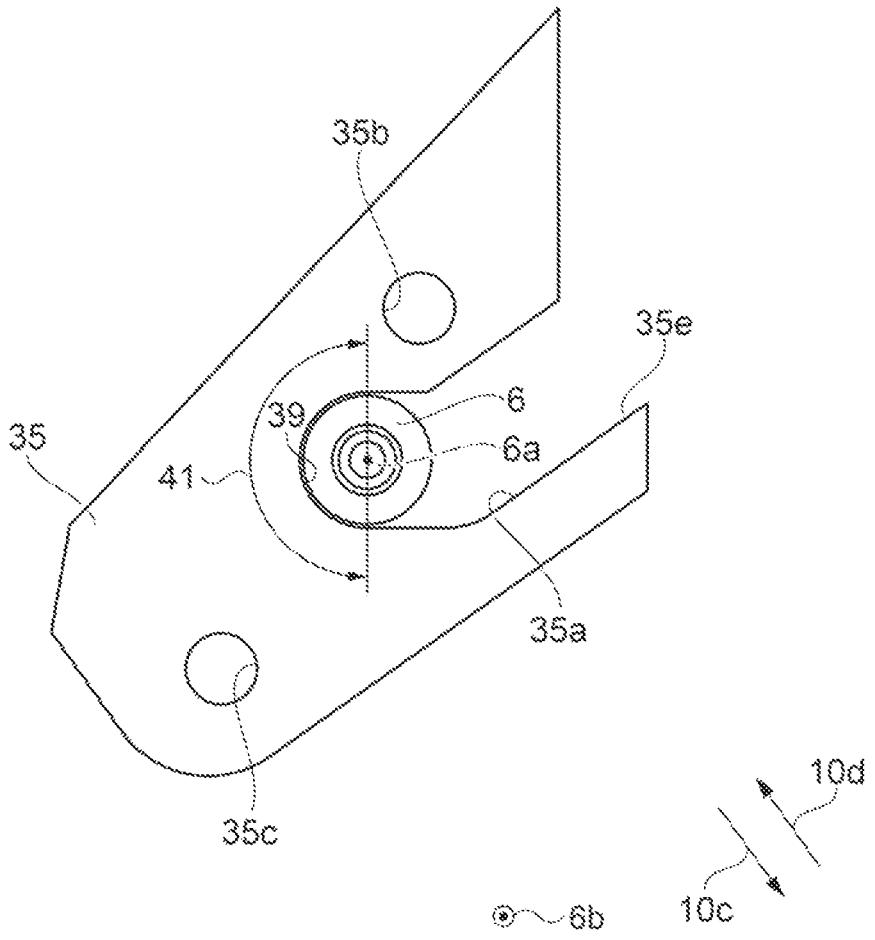
FIG. 19 is a diagrammatic view for describing the shape of recesses.

The shape of the left first recess 36*a*, the right first recess 37*a*, and the second recess 35*a* will next be described. FIG. 19 shows the second piece 35 viewed in the axial direction 6*b*. A second angular range 41, which is formed of angles around the axis 6*a* of the spring rod 6 and corresponds to the range of a second contact section 39, where the second recess 35*a* is in contact with the spring rod 6, is greater than or equal to 20 degrees but smaller than or equal to 180 degrees. When the second angular range 41 is smaller than 20 degrees, the positional shift of the spring rod 6 from the second recess 35*a* in the direction that intersects with the axis of the spring rod 6 can undesirably increase. The positional shift causes the outer circumferential surface of the spring rod 6 to rub against the second recess 35*a* and wear down, undesirably causing the spring rod 6 to rattle relative to the linkage piece. When the second angular range 41 is greater than 180 degrees, the spring rod 6 cannot be inserted into the second recess 35*a* in the direction that intersects with the axis of the spring rod 6.

Figure 20:
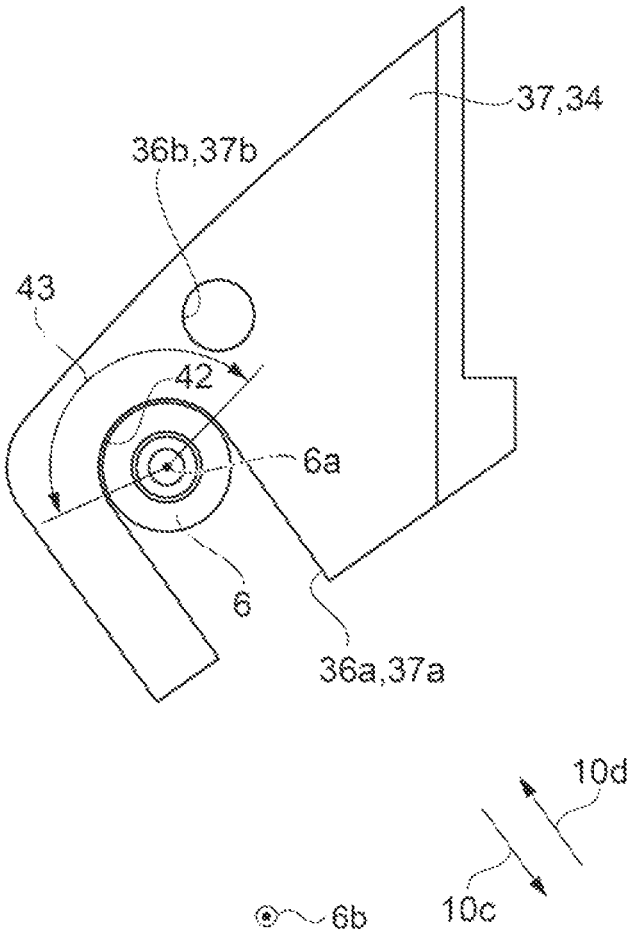
FIG. 20 is a diagrammatic view for describing the shape of the recesses.

FIG. 20 shows the first piece 34 viewed in the axial direction 6*b*. A first angular range 43, which is formed of angles around the axis 6*a* of the spring rod 6 and corresponds to the range of a first contact section 42, where the left first recess 36*a* and the right first recess 37*a* are in contact with the spring rod 6, is greater than or equal to 20 degrees but smaller than or equal to 180 degrees. When the first angular range 43 is smaller than 20 degrees, the positional shift of the spring rod 6 from the left first recess 36*a* and the right first recess 37*a* in the direction that intersects with the axis of the spring rod 6 can undesirably increase. The positional shift causes the outer circumferential surface of the spring rod 6 to rub against the left first recess 36*a* and the right first recess 37*a* and wear down, undesirably causing the spring rod 6 to rattle relative to the linkage piece. When the first angular range 43 is greater than 180 degrees, the spring rod 6 cannot be inserted into the left first recess 36*a* or the right first recess 37*a* in the direction that intersects with the axis of the spring rod 6.

Figure 21:
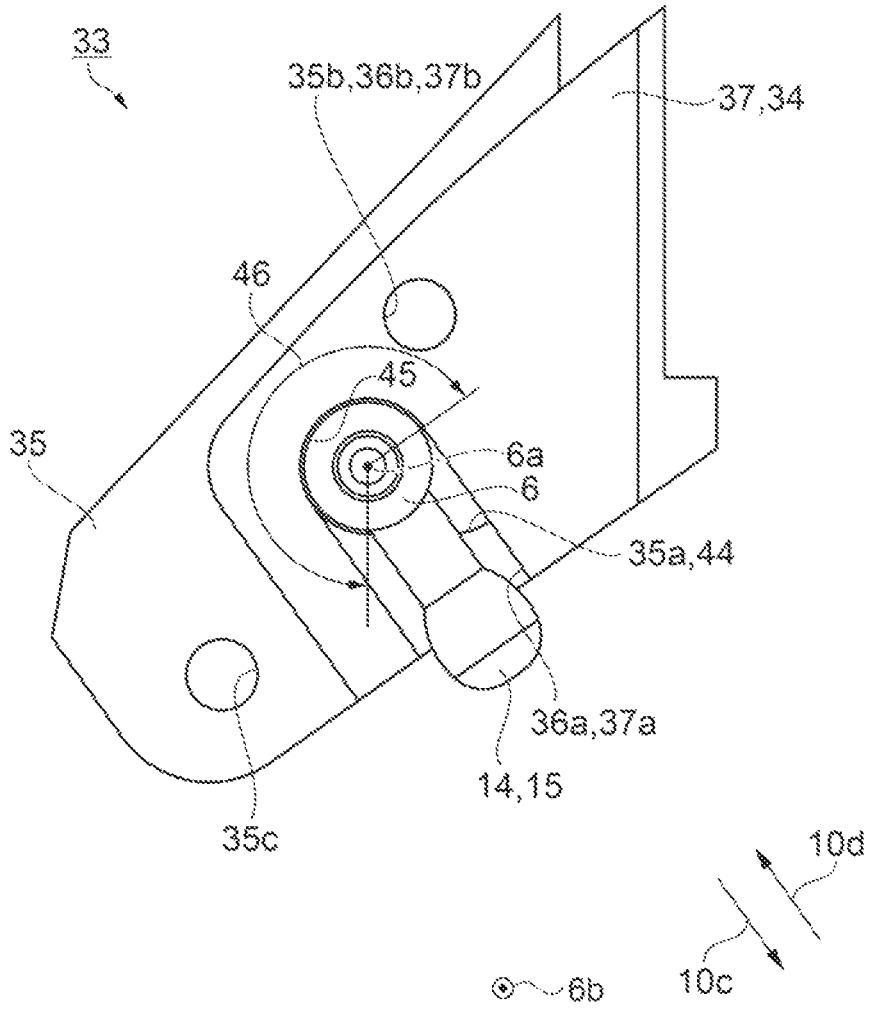
FIG. 21 is a diagrammatic view for describing the shape of a closed curve.

FIG. 21 shows the linkage piece 33 viewed in the axial direction 6*b*. In the side view viewed in the axial direction 6*b* of the spring rod 6, the spring rod 6 is disposed in a closed curve 44, which is the combination of the left first recess 36*a*, the right first recess 37*a*, and the second recess 35*a*.

According to the configuration described above, the spring rod 6 is sandwiched between the first piece 34 and the second piece 35. In this case, the left first recess 36*a*, the right first recess 37*a*, and the second recess 35*a* form the closed curve 44 in the side view viewed in the axial direction 6*b* of the spring rod 6. That is, the left first recess 36*a*, the right first recess 37*a*, and the second recess 35*a* form a hole. The spring rod 6 is disposed in the hole. Therefore, even when the spring rod 6 is provided with the first operation lever 14 and the second operation lever 15, sandwiching the spring rod 6 between the first piece 34 and the second piece 35 readily allows assembly of the band 32 including the spring rod 6. As a result, the operation of fixing the operation lever to the slider with the threads can be eliminated, unlike in JP-A-2020-168218.

A third angular range 46, which is formed of angles around the axis 6*a* of the spring rod 6 and corresponds to the range of a third contact section 45, where any of the left first recess 36*a*, the right first recess 37*a*, and the second recess 35*a* is in contact with the spring rod 6, is greater than 180 degrees but smaller than or equal to 360 degrees.

According to the configuration described above, since the first angular range 43 is smaller than or equal to 180 degrees, the spring rod 6 can be inserted into the left first recess 36*a* and the right first recess 37*a* from the side facing the opening of the recesses. Since the second angular range 41 is smaller than or equal to 180 degrees, the spring rod 6 can be inserted into the second recess 35*a* from the side facing the opening 35*e*. Since the third angular range 46 is greater than 180 degrees, the left first recess 36*a*, the right first recess 37*a*, and the second recess 35*a* can readily form the closed curve 44.

The timepiece 31 includes the band 32 described above. According to the configuration described above, the band 32 is a band into which the spring rod 6 can be readily inserted even when the spring rod 6 is provided with the first operation lever 14 and the second operation lever 15. The timepiece 31 can therefore be a timepiece including the band 32 into which the spring rod 6 provided with the first operation lever 14 and the second operation lever 15 can be readily inserted.

Third Embodiment

The present embodiment differs from the second embodiment in that the second piece 35 is formed of three parts. The same configurations as those in the second embodiment have the same reference characters, and no redundant description of the same configurations will be made.

Figure 22:
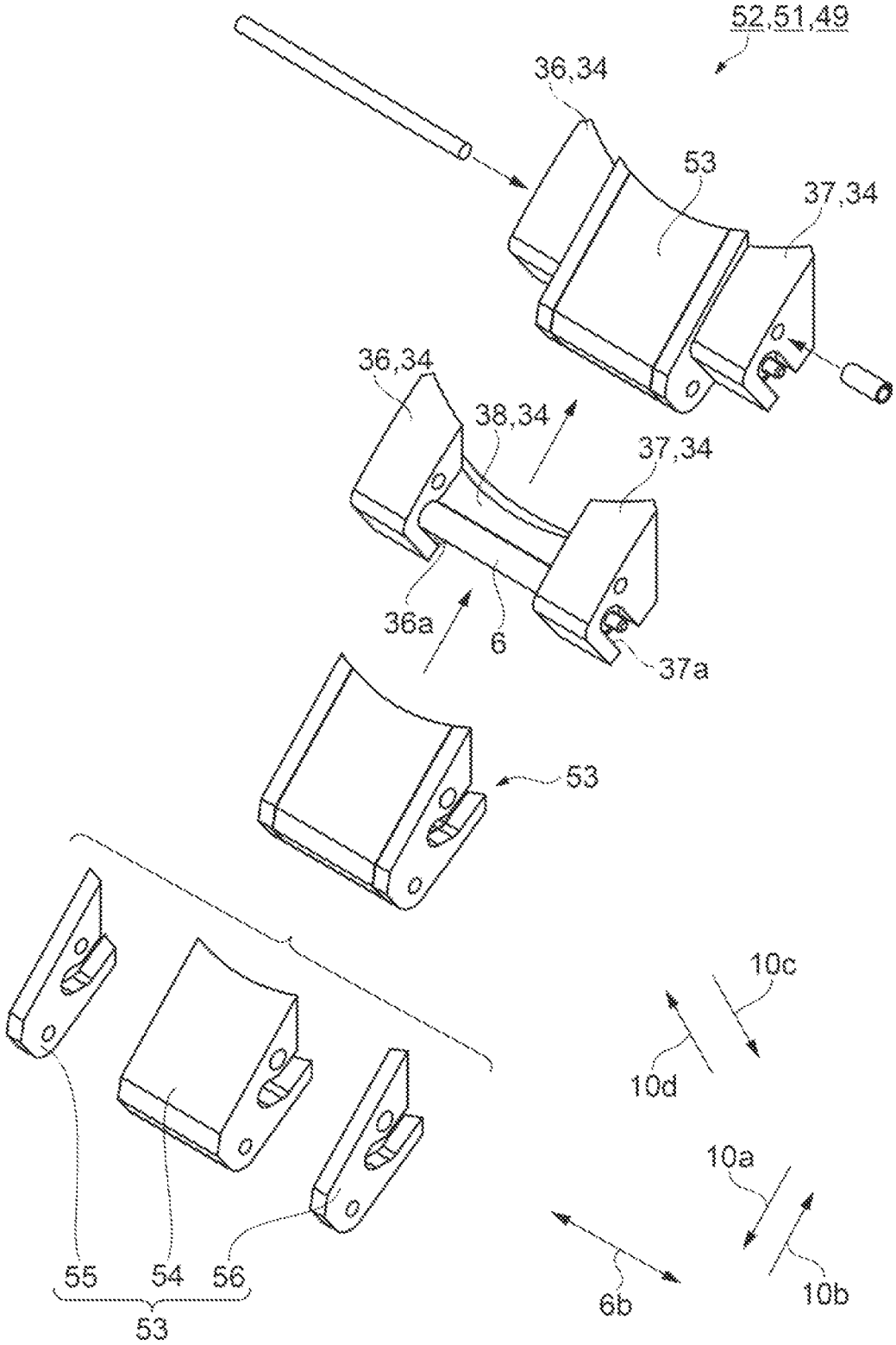
FIG. 22 is a diagrammatic view for describing the configurations of a band and a timepiece and an assembly method according to a third embodiment.

A band 51 of a timepiece 49 includes a linkage piece 52, as shown in FIG. 22. The linkage piece 52 includes the first piece 34, the spring rod 6, and a second piece 53. The shape of the second piece 53 is the same as the shape of the second piece 35 in the second embodiment. The second piece 53 includes a central piece 54 as a piece, a left end piece 55 as a piece, and a right end piece 56 as a piece.

The central piece 54, the left end piece 55, and the right end piece 56 have the same shape when viewed in the axial direction 6*b*. The thickness of each of the pieces is not limited to a specific value, but the left end piece 55 and the right end piece 56 have the same thickness in the axial direction 6*b* and are thinner than the central piece 54.

The second piece 53 is formed of the plurality of pieces arranged in the axial direction 6*b* of the spring rod 6. According to the configuration described above, since the second piece 53 is formed of the plurality of pieces arranged in the axial direction 6*b* of the spring rod 6, a decorative external appearance can be readily achieved.

Fourth Embodiment

The present embodiment differs from the second embodiment in that grooves that hold the operation levers is provided. The same configurations as those in the second embodiment have the same reference characters, and no redundant description of the same configurations will be made.

Figure 23:
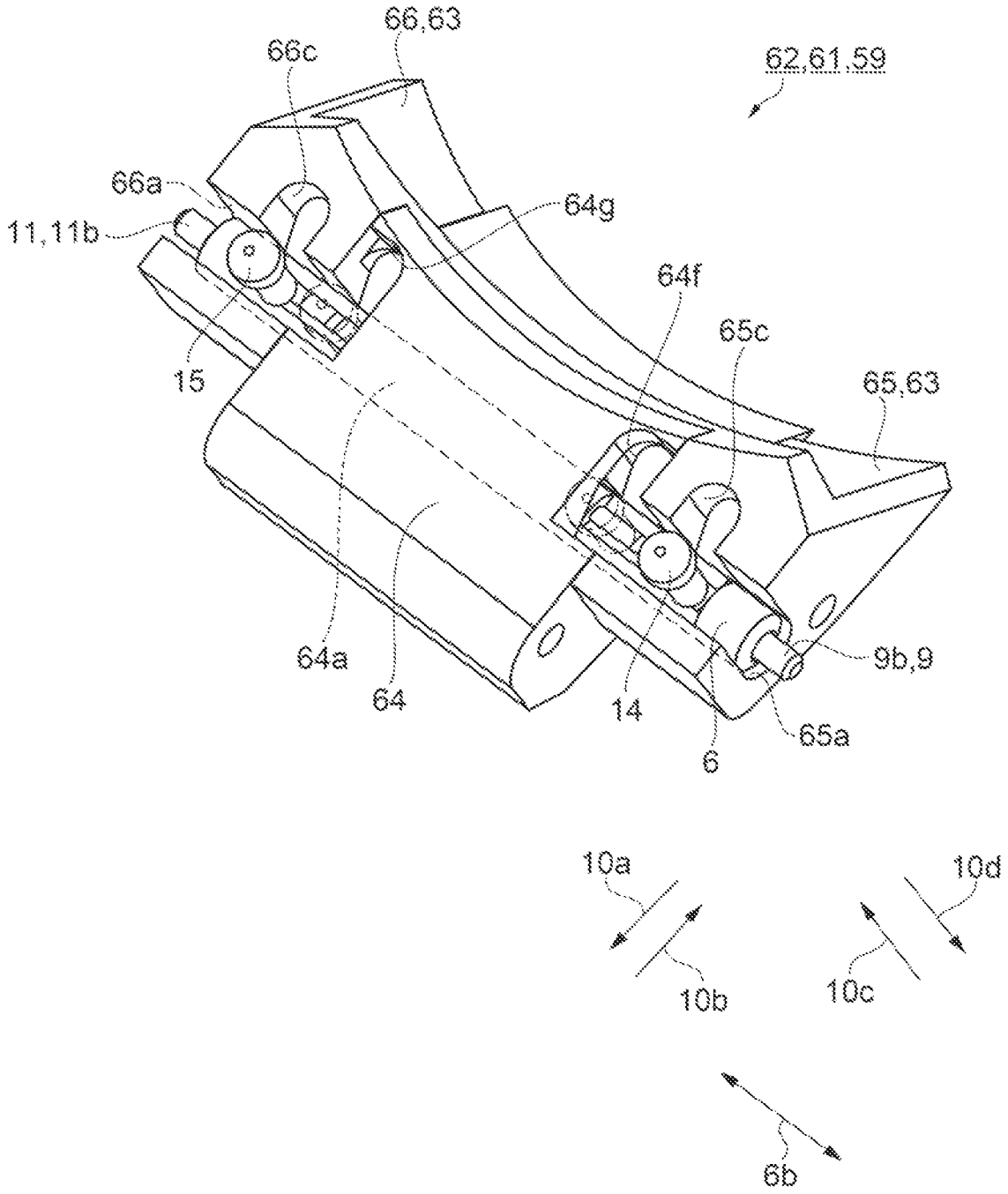
FIG. 23 is a diagrammatic view for describing holding grooves according to a fourth embodiment.

A band 61 of a timepiece 59 includes a linkage piece 62, as shown in FIG. 23. The linkage piece 62 includes a first piece 63, the spring rod 6, and a second piece 64. The first piece 63 includes a first portion 65 and a second portion 66. The first portion 65 has a left first recess 65*a* as the first recess and the third recess. The left first recess 65*a* corresponds to the left first recess 36*a* in the second embodiment. The second portion 66 has a right first recess 66*a* as the first recess and the fourth recess. The right first recess 66*a* corresponds to the right first recess 37*a* in the second embodiment. The spring rod 6 is disposed in the left first recess 65*a* and the right first recess 66*a*.

A first holding groove 65*c* is provided in the first portion 65 of the first piece 63. The first holding groove 65*c* is coupled to the left first recess 65*a* and is disposed on the side shifted from the left first recess 65*a* in the 12-o'clock direction 10*b*. The first holding groove 65*c* holds the first operation lever 14 in a fittable and removable manner.

A second holding groove 66*c* is provided in the second portion 66 of the first piece 63. The second holding groove 66*c* is coupled to the right first recess 66*a* and is disposed on the side shifted from the right first recess 66*a* in the 12-o'clock direction 10*b*. The second holding groove 66*c* holds the second operation lever 15 in a fittable and removable manner.

The second piece 64 has a third holding groove 64*f* and a fourth holding groove 64*g*. The second piece 64 has a second recess 64*a* corresponding to the second recess 35*a* in the second embodiment. The third holding groove 64*f* and the fourth holding groove 64*g* are coupled to the second recess 64*a* and disposed on the side shifted from the second recess 64*a* in the 12-o'clock direction 10*b*. The third holding groove 64*f* is disposed on the side facing the first portion 65. The fourth holding groove 64*g* is disposed on the side facing the second portion 66. The third holding groove 64*f* holds the first operation lever 14 in a fittable and removable manner. The fourth holding groove 64*g* holds the second operation lever 15 in a fittable and removable manner.

Figure 24:
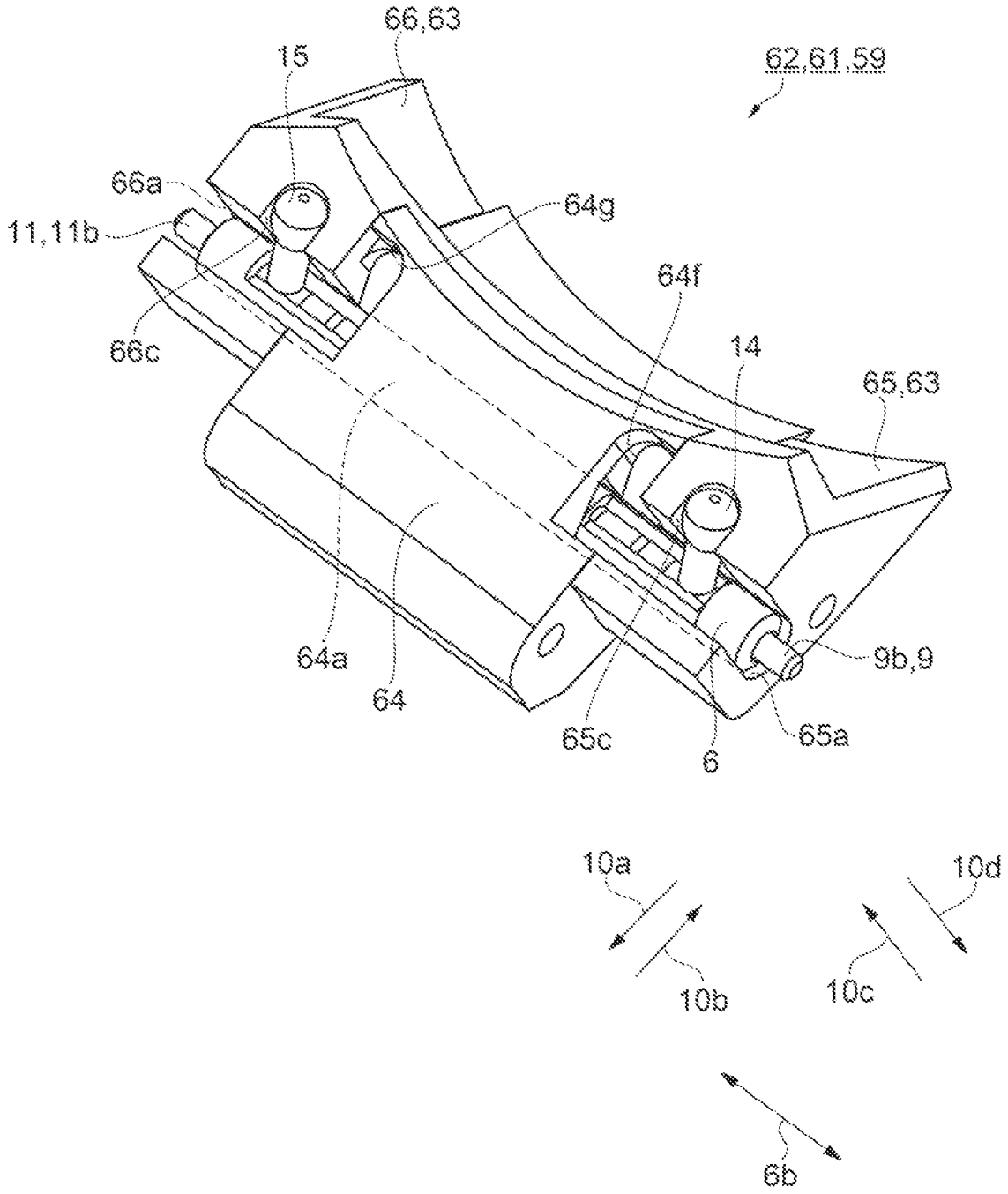
FIG. 24 is a diagrammatic view for describing the holding grooves.

When the operator operates the first operation lever 14 to place the first operation lever 14 in the first holding groove 65*c*, the first protrusion 9*b* of the first slider 9 protrudes out of the left first recess 65*a*, as shown in FIG. 24. When the operator operates the second operation lever 15 to place the second operation lever 15 in the second holding groove 66*c*, the second protrusion 11*b* of the second slider 11 protrudes out of the right first recess 66*a*.

Figure 25:
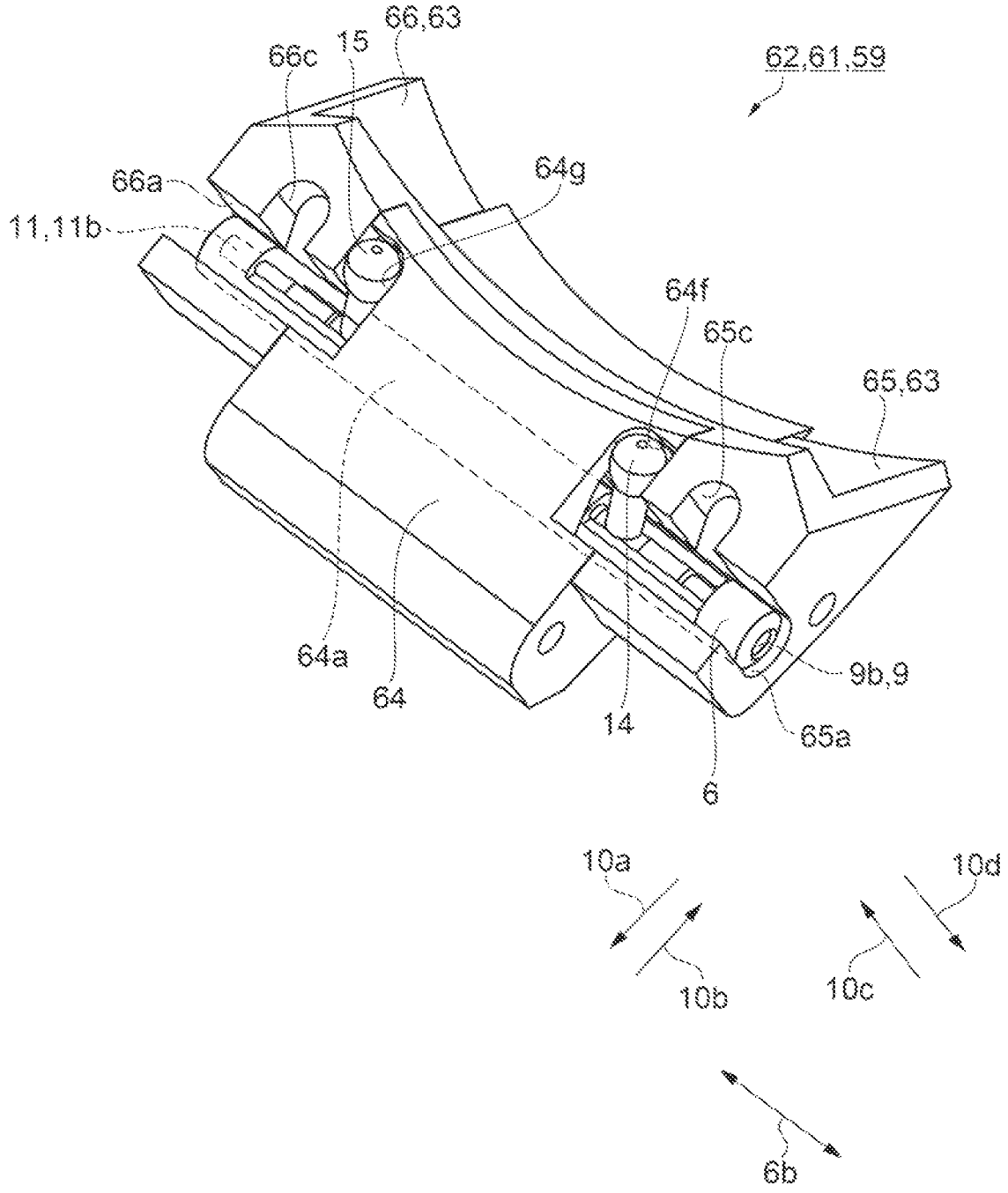
FIG. 25 is a diagrammatic view for describing the holding grooves.

When the operator operates the first operation lever 14 to place the first operation lever 14 in the third holding groove 64*f*, the first protrusion 9*b* of the first slider 9 is retracted in the left first recess 65*a*, as shown in FIG. 25. When the operator operates the second operation lever 15 to place the second operation lever 15 in the fourth holding groove 64*g*, the second protrusion 11*b* of the second slider 11 is retracted in the right first recess 66*a*.

To attach the linkage piece 62 to the case 2, the operator fits the first operation lever 14 into the third holding groove 64*f*. The operator fits the second operation lever 15 into the fourth holding groove 64*g*. The operator then places the linkage piece 62 between the pair of band attaching sections 2*a*. The operator then fits the first operation lever 14 into the first holding groove 65*c*. The operator fits the second operation lever 15 into the second holding groove 66*c*. The first protrusion 9*b* and the second protrusion 11*b* protrude and keeps inserted into the attachment holes 2*b*. The linkage piece 62 therefore keeps linked to the case 2.

According to the configuration described above, the position of the first operation lever 14 can be fixed by fitting the first operation lever 14 into the first holding groove 65*c*. The position of the first operation lever 14 can be changed by removing the first operation lever 14 from the first holding groove 65*c*. The position of the first operation lever 14 can therefore be readily adjusted. Similarly, since the second operation lever 15 can be fitted into and removed from the second holding groove 66*c*, the position of the second operation lever 15 can be readily adjusted.

Fifth Embodiment

The present embodiment differs from the second embodiment in that the left first recess 36*a* and the right first recess 37*a* are not provided. The same configurations as those in the second embodiment have the same reference characters, and no redundant description of the same configurations will be made.

Figure 26:
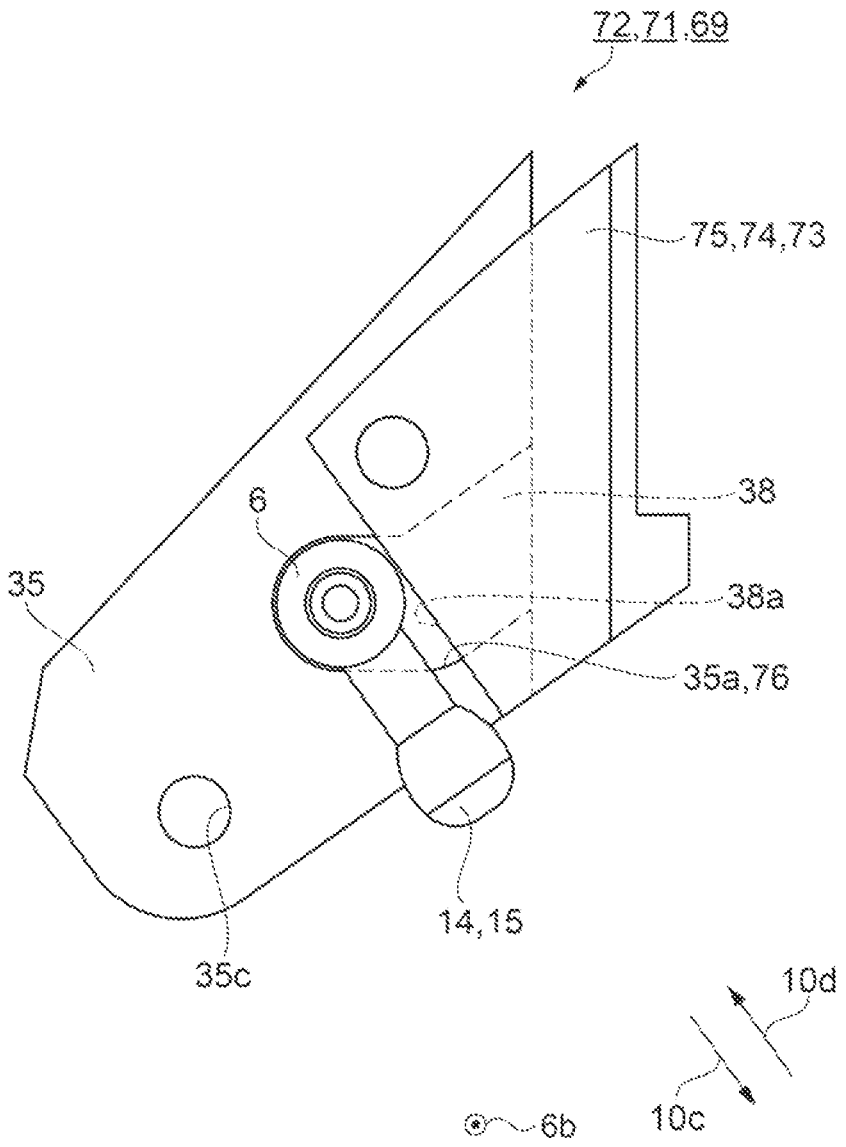
FIG. 26 is a diagrammatic view for describing the shape of a closed curve according to a fifth embodiment.

A band 71 of a timepiece 69 includes a linkage piece 72, as shown in FIG. 26. The linkage piece 72 includes a first piece 73, the spring rod 6, and the second piece 35. The first piece 73 includes a first portion 74 and a second portion 75. The first portion 74 and the second portion 75 are linked to each other via the linkage section 38.

The first portion 74 does not include a portion corresponding to the left first recess 36*a* in the second embodiment. That is, the first portion 74 does not include a portion of the left first recess 36*a* on the 6 o'clock direction 10*a* side. The first portion 74 therefore does not include a portion corresponding to the left first recess 36*a*. The second portion 75 does not have the right first recess 37*a* in the second embodiment. That is, the second portion 75 does not include a portion of the right first recess 37*a* on the 6 o'clock direction 10*a* side. The second portion 75 therefore does not include a portion corresponding to the right first recess 37*a*. The spring rod 6 and the linkage section 38 are inserted into the second recess 35*a*. The second surface 38*a* of the linkage section 38 and the second recess 35*a* form a closed curve 76.

In the side view viewed in the axial direction 6*b* of the spring rod 6, the spring rod 6 is disposed in the closed curve 76, which is the combination of the second recess 35*a* overlaps with the linkage section 38. According to the configuration described above, the second recess 35*a* and the linkage section 38 form the closed curve 76 in the side view viewed in the axial direction 6*b* of the spring rod 6. That is, the second recess 35*a* and the linkage section 38 form a hole. The spring rod 6 is disposed in the hole. Therefore, even when the spring rod 6 is provided with the first operation lever 14 and the second operation lever 15, sandwiching the spring rod 6 between the first piece 73 and the second piece 35 readily allows assembly of the band 71 including the spring rod 6. As a result, the operation of fixing the operation lever to the slider with the threads can be eliminated, unlike in JP-A-2020-168218.

Sixth Embodiment

In the first to fifth embodiments described above, in the side view of any of the pieces, the recess of the piece has an arc, the recess may not have an arc and may be formed only of straight lines. For example, any of the pieces in a cross-sectional view may be a V-shaped recess.

What is claimed is:

1. A band comprising:

a spring rod including a first operation lever linked to a first slider and a second operation lever linked to a second slider;

a linkage piece including a first piece and a second piece;

the first piece including a first portion, a second portion, and a linkage section that links the first portion and the second portion to each other; and the second piece disposed between the first portion and the second portion, wherein the first piece has a first recess in each of the first portion and the second portion, the second piece has a second recess, in a side view viewed in an axial direction of the spring rod, the spring rod is disposed in a closed curve that is a combination of the first recess and the second recess or a combination of the second recess and the linkage section, the second piece is disposed between the first operation lever and the second operation lever, and wherein a first angular range that are formed of angles around an axis of the spring rod and correspond to a range of a first contact section where the first recess is in contact with the spring rod is smaller than or equal to 180 degrees, a second angular range that are formed of angles around the axis of the spring rod and correspond to a range of a second contact section where the second recess is in contact with the spring rod is smaller than or equal to 180 degrees, and a third angular range that are formed of angles around the axis of the spring rod and correspond to a range of a third contact section where the first recess and the second recess are in contact with the spring rod is greater than 180 degrees.

2. The band according to claim 1, wherein the linkage section is disposed in an opening of the second recess.

3. The band according to claim 1, wherein assuming that the first recess of the first portion is called a third recess and that the first recess of the second portion is called a fourth recess, the first operation lever is disposed in the third recess of the first portion and the third recess restricts rotational movement of the first operation lever, and the second operation lever is disposed in the fourth recess of the second portion and the fourth recess restricts rotational movement of the second operation lever.

4. The band according to claim 1, wherein a first hole formed in the first piece and a second hole formed in the second piece are arranged along a single line, and a pin is inserted into the first hole and the second hole to fix the first piece and the second piece to each other.

5. The band according to claim 1, wherein the second piece is formed of a plurality of pieces arranged in the axial direction of the spring rod.

6. The band according to claim 1, wherein the first portion of the first piece is provided with a first holding groove that holds the first operation lever in a fittable and removable manner, and the second portion of the first piece is provided with a second holding groove that holds the second operation lever in a fittable and removable manner.

7. A timepiece comprising the band according to claim 1.

* * * * *